US007131615B1

(12) United States Patent
Bruce

(10) Patent No.: US 7,131,615 B1
(45) **Date of Patent: *Nov. 7, 2006**

(54) ADJUSTABLE MUSICIAN'S STAND

(76) Inventor: Harper M. Bruce, 211 Becca La., Stroudsburg, PA (US) 18360

( * ) Notice: Subject to any disclaimer, the term of this patent is extended or adjusted under 35 U.S.C. 154(b) by 0 days.

This patent is subject to a terminal disclaimer.

(21) Appl. No.: 10/823,092

(22) Filed: Apr. 13, 2004

Related U.S. Application Data

(63) Continuation-in-part of application No. 10/145,051, filed on May 14, 2002, now Pat. No. 6,720,490.

(51) Int. Cl.
*A45D 19/04* (2006.01)

(52) U.S. Cl. ..... 248/127; 84/327; 248/346.07

(58) Field of Classification Search ..... 248/127, 248/346.01, 346.03, 346.06, 346.07; 84/327, 84/328, 329, 421, 453
See application file for complete search history.

(56) References Cited

U.S. PATENT DOCUMENTS 4,067,527 A * 1/1978 Streit ..... 248/123.2
4,407,182 A * 10/1983 Biasini ..... 84/453
4,738,425 A * 4/1988 Foster ..... 248/346.01
5,340,066 A * 8/1994 Ditch ..... 248/170
6,121,527 A * 9/2000 Hamm ..... 84/327
6,215,054 B1 * 4/2001 Woodhouse et al. ..... 84/421
6,215,056 B1 * 4/2001 Liao ..... 84/422.3
6,281,417 B1 * 8/2001 Ladao ..... 84/327
2003/0062663 A1 * 4/2003 Fox ..... 269/17

FOREIGN PATENT DOCUMENTS

EP 117933 * 9/1984

* cited by examiner

*Primary Examiner*—Ramon O Ramirez
(74) *Attorney, Agent, or Firm*—Charles A. Wilkinson; Clinton H. Wilkinson

(57) ABSTRACT

A stand for holding a musical accessory at a convenient level having a horizontally adjustable base comprised of a plurality of adjustable telescoping members forming a U-shape base support, such that the members of the base can be adjusted to extend around other equipment in a crowded stage area, thereby conserving space and enabling the stand to be conveniently situated closely together with such other equipment.

17 Claims, 14 Drawing Sheets

ADJUSTABLE MUSICIAN'S STAND

CROSS REFERENCE TO RELATED APPLICATION

The application is a Continuation-in-Part Application based upon and taking priority from U.S. patent application Ser. No. 10/145,051 filed on May 14, 2002, now U.S. Pat. No. 6,720,490 issued on Apr. 13, 2004.

BACKGROUND OF THE INVENTION

1. Field of the Invention

The present invention relates to stands used by musicians, and more particularly to a microphone, music, or instrument stand having a horizontally adjustable base particularly for use on a crowded stage or performing area and capable of extending around floor supported musical equipment as well as supporting various musical instruments and musical accessories.

2. Preliminary Discussion

Individual musicians such as guitarists or vocalists, as well as musical groups or bands, often perform in venues such as clubs, bars and the like where the stage or performing area is quite small. For example, many corner bars or clubs do not even have a separate stage area, and performers must clear an area of tables, chairs and other like items prior to setting up their equipment. In such situations, there is barely room for a band having several members to set up such equipment, which typically includes several microphone stands, amplification equipment, control processors, a keyboard, drum set and the like. In addition, after such equipment has been set up, there may be little room left over for the band members to move around during their performance, as they typically may desire. Even in clubs having larger performing areas, space is still at a premium, since most band members prefer to be able to move around the stage freely without having to worry about tripping over or running into their equipment.

Performers who both play an instrument, such as an electric guitar, while also providing vocals' encounter a slightly different space problem. Particularly where there is a limited area to move around, such performers will often remain in a more or less stationary position. However, it can be difficult to orient both a foot controller or processor equipment for an electric guitar and a microphone or music stand so that both are in sufficiently close proximity to the performer so that they can be reached without the performer having to continually change or shift positions. This difficulty is largely due to the shapes of such equipment. A typical microphone stand is comprised of a vertically adjustable telescoping pole connected to a round, weighted base situated directly beneath the pole, and is normally placed more or less directly in front of the performer so that the microphone is in close proximity to the performer's face and mouth whenever vocals are required. Electronic guitar foot controls or processing equipment are usually enclosed in a generally rectangular holder or box-like structure which also must be placed in close proximity to the performer so that such foot controls can be comfortably reached by the performer without requiring him or her to shift positions or move away from the microphone. However, placement of the round microphone stand base directly in front of the performer leaves little room for the foot controller. This conflict can adversely affect the quality of the performance, since the microphone and foot controls often may be required to be used simultaneously. The instant invention attempts to overcome this conflict by providing a microphone stand having a base that can be horizontally adjusted for placement around a foot controller or other objects, permitting both the microphone and foot controls to be directly in front of, and therefore within easy reach of, the performer.

In addition, there is frequently other equipment to support as well as floor equipment which is conveniently bracketed by any equipment stands necessary to support elevated equipment and the present music accessories stand is particularly designed to support such equipment while conserving floor space.

3. Description of Related Art

Numerous examples of arrangements for stacking and folding microphone or music stands, or for adjusting the height of such stands, are known in the prior art. In addition, other types of music equipment such as electronic keyboards are usually provided with a support or frame structure. However, the inventor is not aware of a stand for holding a microphone, sheet music, or a small instrument such as a harmonica or large equipment or instruments which stand can be horizontally adjusted to be situated around other equipment used by a musician, such as a foot controller or audio amplifier, thereby making it easier to simultaneously use such equipment while also conserving space in a small or cramped stage area.

For example, U.S. Pat. No. 4,067,527 issued Jan. 10, 1978 to J. L. Streit entitled "Musical Instrument Support Stand With Counter-Balanced, Vertically Movable Horn Support Rack," discloses a stand having a generally U-shaped base when unfolded and in which the legs are folded parallel to the base when not in use.

U.S. Pat. No. 4,407,182 issued Oct. 4, 1983 to A. R. Biasini entitled "Musical Instrument Stand," discloses a tripod-like stand having telescoping legs which collapse during storage, but are meant to be fully extended during use and collapsed when not in use when they are stored in the hollow bottom.

U.S. Pat. No. 4,445,415 issued to G. J. Izquierdo on May 1, 1984, entitled "Portable Case and Stand for Pedal Controls Operationally Fixed Therein for use with a Keyboard Temporarily Mounted Thereon," discloses a box structure having several pedal controls for an electronic keyboard permanently mounted therein, which structure is also used to support an electric keyboard. Izquierdo is an example of a time and space-saving arrangement wherein the pedal controls can be situated underneath or in a music stand. However, instruments such as an electronic keyboard, which are elongated in shape, intrinsically have a space provided underneath such instrument for placement of the legs of the user, while stands for sheets of music, a microphone, or instruments such as a harmonica or drum machine typically do not provide such space.

U.S. Pat. No. 4,449,010 issued to F. L. Seebinger on May 15, 1984, entitled "Multi-Position Microphone Stand Support Assembly," discloses a support for a microphone wherein the vertical support column is pivotable, while the base remains stationary. Such stand allows for more than one microphone to be attached to the support, but does not disclose a horizontally adjustable base.

U.S. Pat. No. 4,718,624 issued to R. G. Greulich on Jan. 12, 1988, entitled "Folding Microphone Stand," discloses a tripod-type stand in which the support column can be pivoted on the base member, and having an aperture in the base member to accommodate the support column in a fully folding position. Pivoting the support column in relation to the base allows for easier transport or storage of the stand when it is not in use. However, in general folding tripod-type microphone stands are not preferred because they pass unwanted vibrations to the microphone.

U.S. Pat. No. 5,048,789 issued to D. H Eason et al. on Sep. 17, 1991, entitled "Microphone Stand," discloses a stand having a generally circular base and a U-shaped cutout portion so that several of such bases can be overlapped or stacked when stored. Eason et al. illustrates several other embodiments in which the base portion has a slightly different configuration while still retaining its stackable characteristics. However, none of such embodiments illustrates a base, which can be horizontally adjusted so as to fit around equipment such as a foot controller.

U.S. Pat. No. 5,090,648 issued to W. R. Wood, IV on Feb. 25, 1992, entitled "Stand Assembly," discloses a stand for holding doors, windows, and the like during painting. The base members of the Wood stand do not appear to be adjustable, however.

U.S. Pat. No. 5,106,048 issued to M. Lebar et al. on Apr. 21, 1992, entitled "Support Stands" discloses a music stand having tripod-type support legs wherein two of the legs are pivotable so that the legs can be folded in a storage position. Tripod-type support stands are well known in the prior art and may possibly be placed over or around a foot controller, but are not adjustable in the same manner as the present invention.

U.S. Pat. No. 5,149,901 issued to M. C. Boor et al. on Sep. 22, 1992, entitled "Guitar Support Apparatus," discloses a support for a guitar having a pair of parallel pipe-like legs with vertically extending supports spaced thereon.

U.S. Pat. No. 5,340,066 issued to K. J. Ditch on Aug. 23, 1994, entitled "Stand for Article," discloses another tripod-type adjustable microphone wherein one leg has incorporated a tilt assembly, which allows the angle of the microphone to be adjusted.

U.S. Pat. No. 5,611,508 issued to A. Palmero on Mar. 18, 1997, entitled "Horizontally Adjustable Microphone Support," discloses a microphone support having a telescoping horizontal cross member attached to the upper end of the vertical support column. The base member in Palmero, however, is a typical round base and is not adjustable.

U.S. Pat. No. 5,857,649 issued to D. H. Eason on Jan. 12, 1999, entitled "Stabilizing and Memory Musical Instrument Stand," discloses a music stand having a support frame shaped as a cross-frame which is pivotable about the intersection of the frame members.

U.S. Pat. No. 5,863,015 issued to H. Hsu on Jan. 26, 1999, entitled "Microphone Stand Elevating Device, discloses a device which makes it easier to upwardly or downwardly adjust the height of a microphone support column extending from the base of a microphone stand, although the configuration of the base cannot be adjusted.

U.S. Pat. No. 5,893,541 issued to D. Michaelson on Apr. 13, 1999, entitled "Microphone Stand Providing Quick Assembly and Disassembly," discloses an improved means for quickly assembling and disassembling a support column from a microphone stand base. The base, however, is made from a single generally oval solid structure and is not adjustable.

U.S. Pat. No. 6,215,054 issued to K. S. Woodhouse et al. on Apr. 10, 2001, entitled "Musical Instrument Support Stand," discloses a stand having telescoping legs which are secured in position using finger screws, in which the legs of the stand all extend outwardly from a central hub.

U.S. Pat. No. 6,215,056 issued to T. Liao on Apr. 10, 2001 entitled "Adjustable Foot Structure for Hi-Hat Cymbal," discloses a cymbal stand having an adjustable foot member attached to the bottom of a stand member.

Despite the numerous microphone and music stands known in the prior art, each of which provides its own degree of utility, there is a need for a stand having a base portion which incorporates usable space in the center and which can be adjusted to conserve space on a cramped or crowded stage or performing area so as not to interfere with the placement of other music or performing equipment.

OBJECTS OF THE INVENTION

It is therefore a primary object of the invention to provide a stand for holding a microphone, sheet music, instrument or the like.

It is a further object of the invention to provide a stand providing floor space in the center portion of the base of the stand to accommodate music or other performing equipment.

It is a further object of the invention to provide a stand having a base portion comprised of a plurality of telescoping members which are independently adjustable.

It is a still further object of the invention to provide a stand wherein the telescoping members can be adjusted so as to surround or avoid other music equipment or control boxes on a stage floor such as speakers, foot controllers or effects processors.

It is a still further object of the invention to provide a stand which requires a minimum amount of space on a stage or performing area.

It is a still further object of the invention to provide a stand providing floor space in the center which can be used in various locations about a musician on a crowded stage.

It is a still further object of the invention to provide a base which can be used to support a microphone stand, music stand, or instrument.

It is a still further object of the invention to provide a base which can accommodate support of several different instruments.

It is a still further object of the invention to provide a base for a microphone, instrument, or music stand which can be easily and quickly set up and stored in a compact configuration when not in use.

Still other objects and advantages of the invention will become clear upon review of the following detailed description in conjunction with the appended drawings.

SUMMARY OF THE INVENTION

A stand for use as a microphone stand, music stand, or instrument stand is provided having a telescopingly adjustable base arrangement which is designed to be used particularly in relatively cramped stage or performing areas where there is a need to conserve space, although such arrangement could be used in any performing area. Performers, particularly those musicians or bands performing in a small club or bar environment, often encounter a problem in that there is insufficient room to set up all of their electronic equipment in a reasonably effective manner. The present invention addresses this problem by providing a stand having a generally U-shaped frame or support providing floor space within the center of the "U" and wherein the length of the support members is adjustable so that the support members can be positioned compactly around other equipment such as processors or controllers, thereby more efficiently using the available floor space in setting up such equipment. The pitch or angle of the vertical microphone support column can be adjusted using screw-type foot members on the bottom of the stand. In addition, the foot members provide sufficient room between the floor and horizontal support members so that electric control wires powering the effects processor, instruments, or other equipment can be slipped under such members. The stand can be used not only to accommodate or hold a microphone before a musician on a crowded or cramped stage, but to accommodate an instrument in back of or toward either side of a musician as well as other equipment.

DESCRIPTION OF THE PREFERRED EMBODIMENTS

Figure 1:
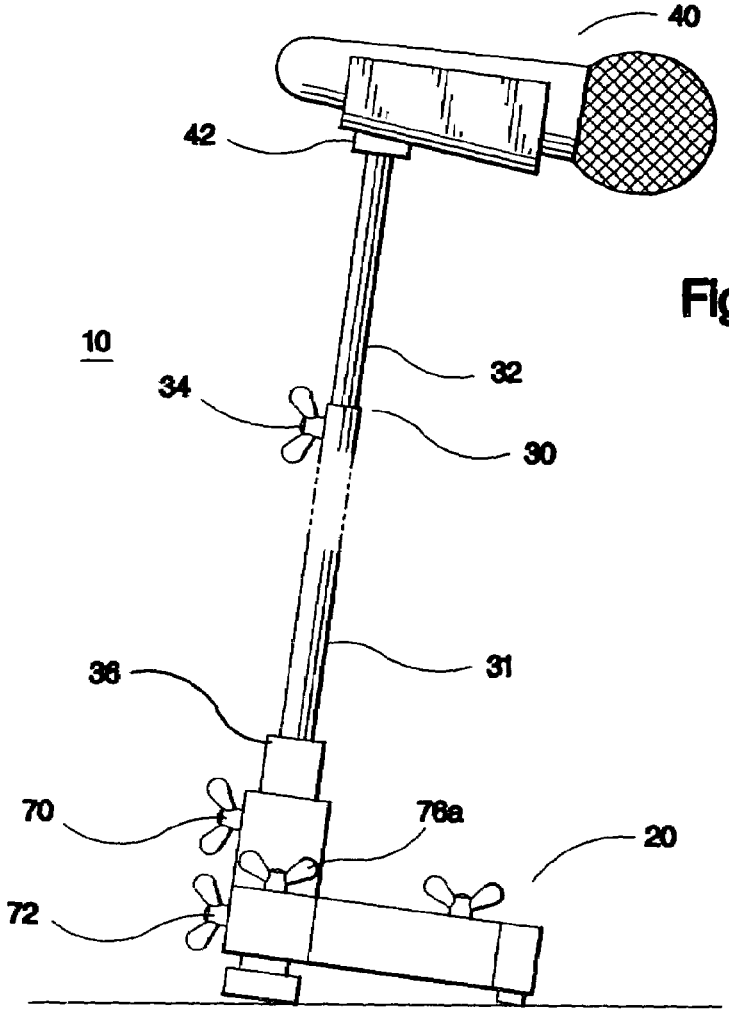
FIG. 1 is side elevation of the stand of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

It is frequently necessary or desirable to situate control pedals and other control equipment for loud speakers and other musical, performance and special effects equipment directly in front of a performer, which performer usually is also using a microphone or the like in his or her musical or other artistic performance. In a very large music hall or similar performing environment, there are usually sound men and other technical personnel to handle the operation of sound equipment, modify its effects from time to time as necessary, and generally monitor and adjust the rendition of any performance. A lone performer before smaller audiences, on the other hand, must modify the sound and musical effects him or herself and, since such performer cannot or should not, from an artistic viewpoint, be seen continually adjusting various knobs, dials, switches and the like, foot control pedals are usually provided to allow the performer adequate control of the technical aspects of sound control. Operation of such foot controls is not as visible and distracting to an audience as hand manipulation would be, and frequently an artists hands are otherwise occupied in any event. The most convenient and logical location for such foot control and other equipment is directly in front of the performer. However, where the performer is using a standup microphone, as is frequently necessary, if the artists hands are busy, the microphone base must also be in front of the performer unless the microphone can be supported on a pivoted or counterbalanced beam or pole arrangement from the side, which is sometimes done, or can be hung from the ceiling of the performing area, which is seldom possible in smaller or more general, as distinguished from, professional or specialized performing facilities. Consequently, there is considerable agonizing, adjusting and improvising by an artist before each performance trying to arrange the floor equipment such as foot controls and the like and the base of microphones and the like with respect to the performer. Not only is this improvising period time-consuming, but it also is tension-inducing for the performers and distracting during actual performance. The present inventor, having been presented as a performer with the problem, has ingeniously solved it by providing not only a microphone stand providing floor space in the center directly under the microphone, but one that is freely adjustable so that such stand can be readily adapted to performing equipment of various dimensions while maintaining the floor space taken up by the various equipment at a minimum. Thereby, a very significant problem for performers has been solved in a simple and expedient manner.

The same problem which occurs with microphone bases also frequently occurs with respect to music stands, instrument stands where an instrument must be partially supported or where a single musician must take up alternative instruments during a performance, and in such cases the present invention provides an open base stand with adjustable lateral dimensions which may be used also with great effectiveness. The stand of the invention or base for a stand of the invention is particularly useful also where the stage or performing area is cramped and lacking in space as very many less professional performing areas are.

The inventor has now also discovered that his basic microphone base which provides room at the center of the base for foot controls and the like, as shown and described in his previous application with respect to which this application is a continuation-in-part, can also with little or no substantial modification be used to support holders for instruments behind or to the sides of the performer and can in the same manner surround a loudspeaker or amplifier equipment behind the performer. The inventor has designed further attachments for his stand and base including an improved arrangement for decreasing the dimensions of the folded base for storage and transportation between appearances of the artist.

Reference will now be made in detail to a presently preferred embodiment of the invention as illustrated in the accompanying drawings. Whenever possible, the same reference numbers will be used throughout the drawings to refer to the same or like parts.

Figure 2:
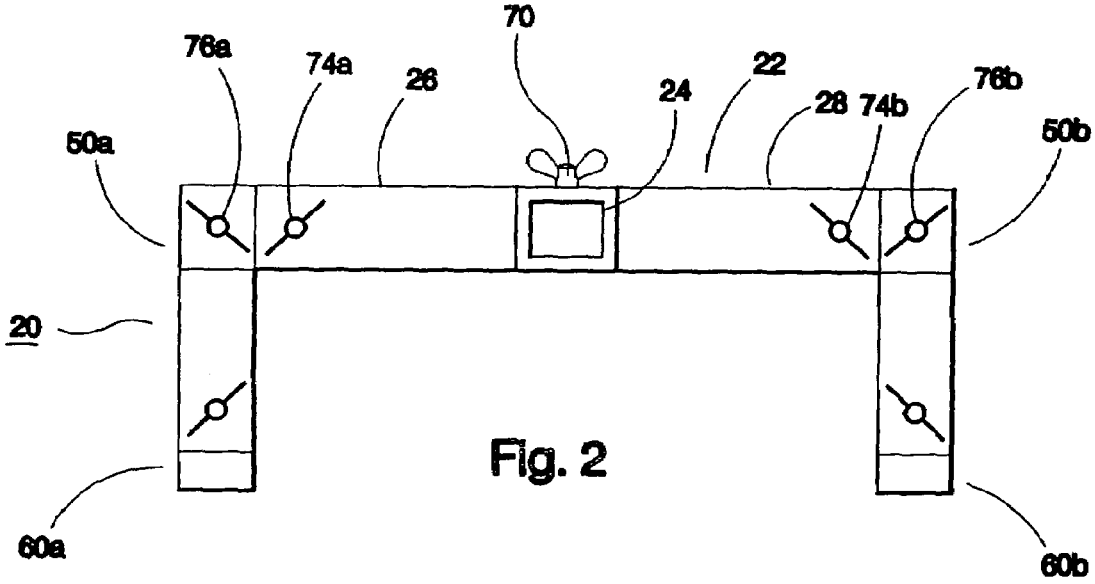
FIG. 2 is a top or plan view of the base portion of the stand of the present invention.
Figure 3:
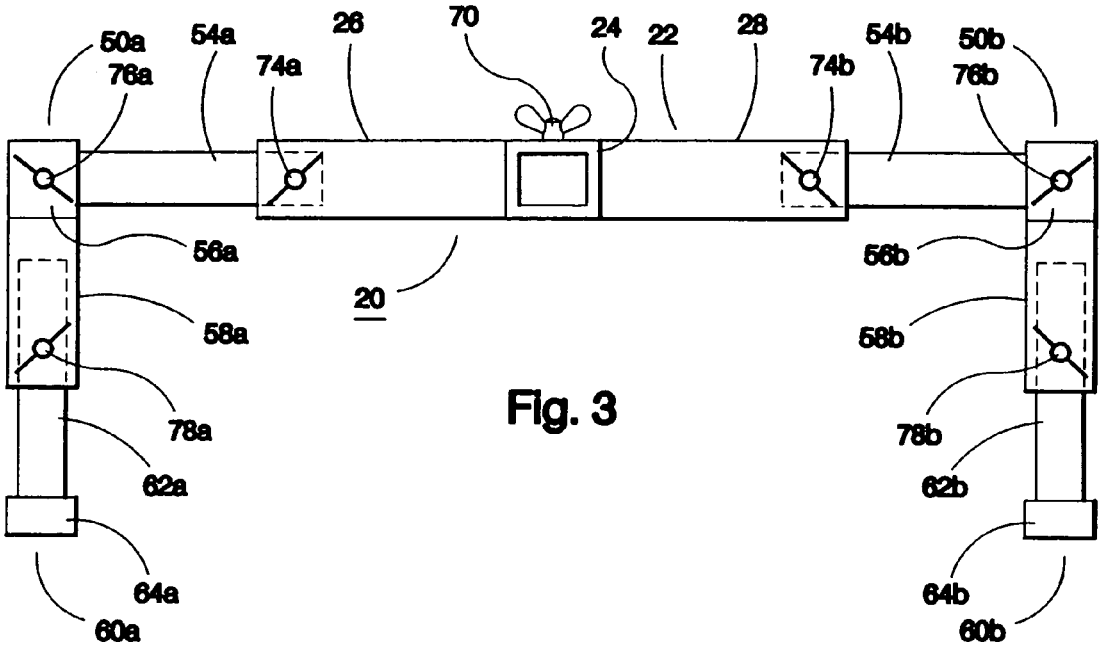
FIG. 3 is a top or plan view of the base portion of the stand similar to FIG. 2 with the individual telescoping base members extended to or toward their maximum.
Figure 4:
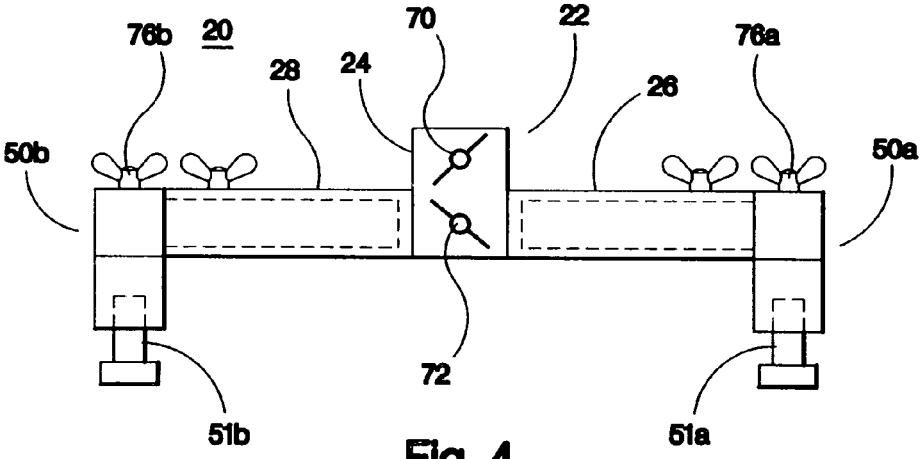
FIG. 4 is a rear view of a slightly alternative version of the base, as it would originally be viewed from the audience side.
Figure 5:
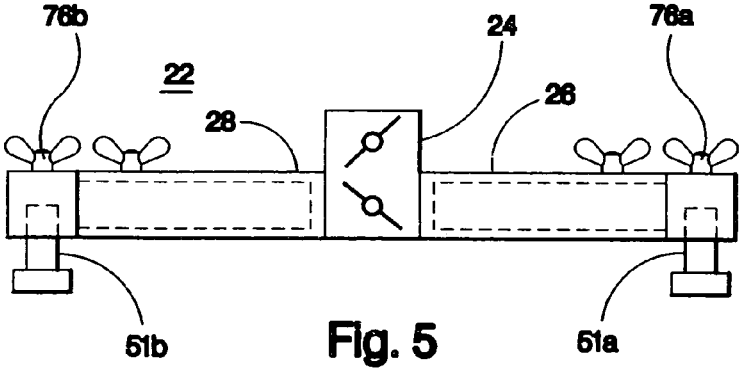
FIG. 5 is a rear view of the base as shown in FIGS. 1–3, as it would normally be viewed from the audience side.
Figure 6:
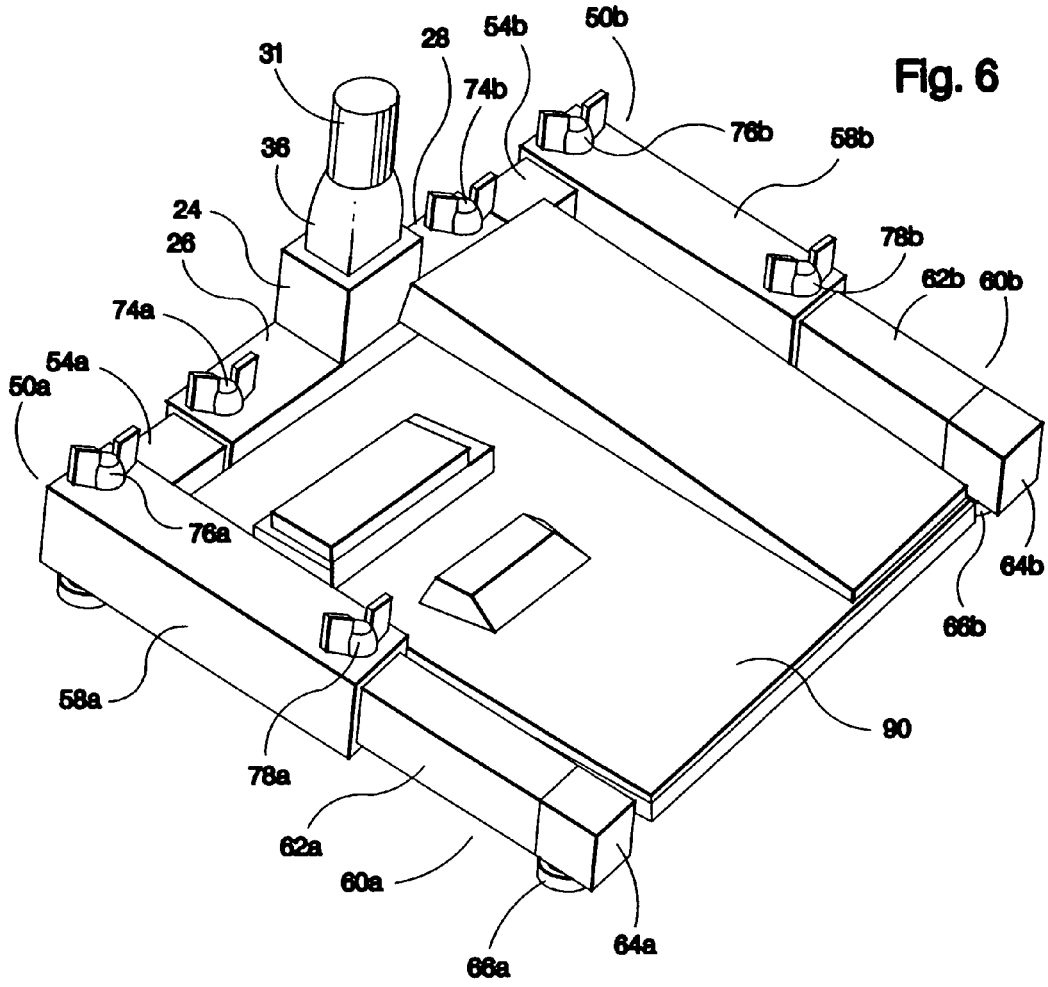
FIG. 6 is an isometric view of the base surrounding a typical foot control device.
Figure 7:
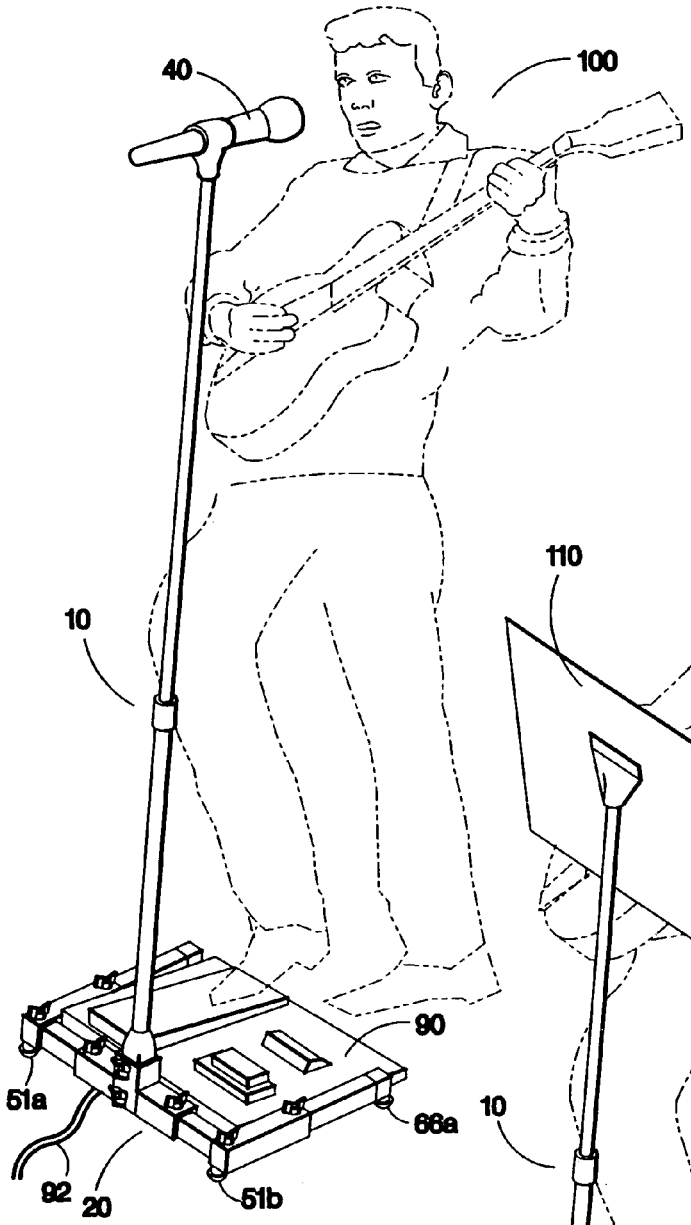
FIG. 7 is an isometric view of an artist using a microphone mounted on the stand of the invention shown in FIG. 5.
Figure 8:
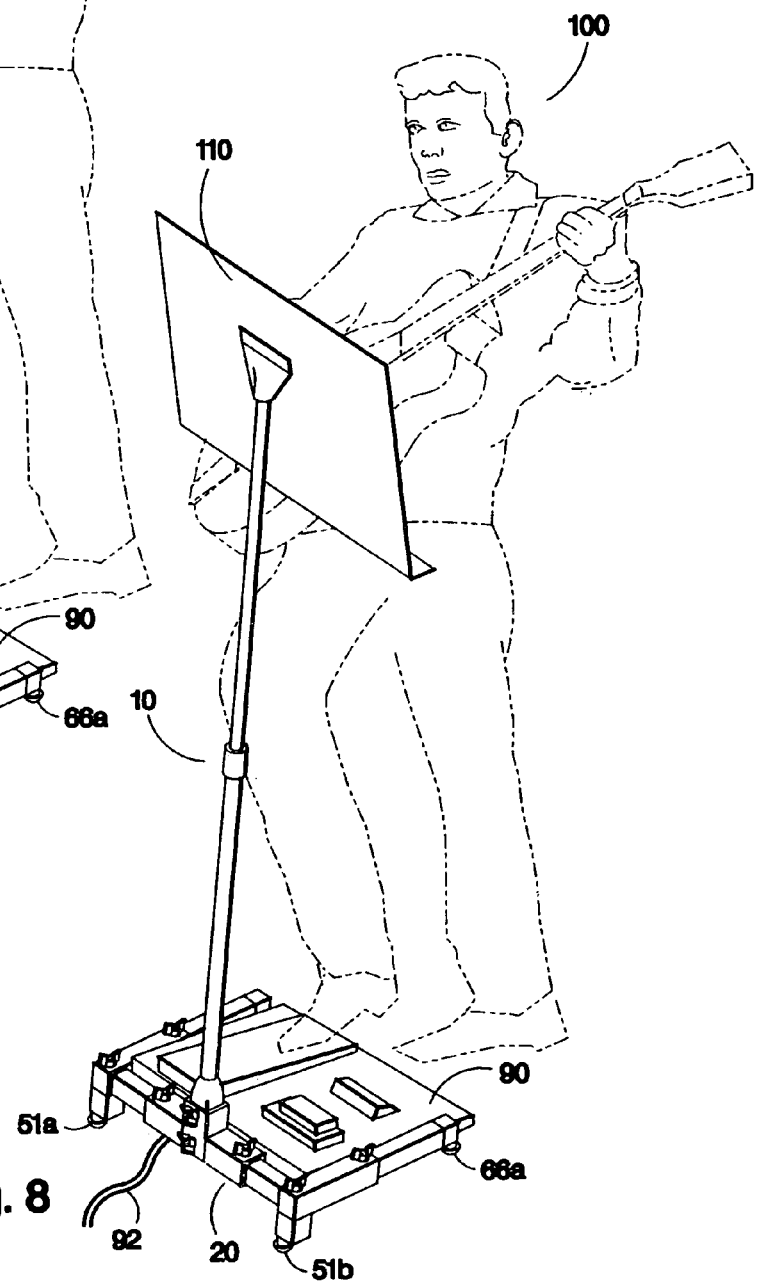
FIG. 8 is an isometric view of an artist using the stand of the invention shown in FIG. 4 as a music stand.

FIGS. 1–9 illustrate a first preferred embodiment of the invention, with FIGS. 4 and 8 illustrating a slightly alternative embodiment, while FIGS. 10–15 illustrate another possible alternative embodiment. FIG. 1 is a side elevation view of the first preferred embodiment of the adjustable musician's stand 10 of the present invention. While such example of the invention illustrates the stand 10 supporting a microphone 40, it is envisioned that the stand 10 can also be used as a music stand, instrument stand, or the like. In addition, the scale of FIG. 1 may appear distorted because the microphone 40 appears large compared to the microphone support rod or member 30. However, support rod 30 should be understood to be considerably longer, it having been foreshortened in the figure by not showing a central section indicated by dotted lines, and in actuality, the usual microphone support rod will be three or four times as lengthy and usually telescopically adjustable as described below. A typical microphone supported on a stand in accordance with the invention in use by a performing artist is shown in FIG. 7.

Referring still to FIG. 1, stand 10 is generally comprised of a base 20 supporting or being coupled to a vertically extending post or support member 30, with microphone 40 secured on the upper end of support member 30 by bracket or clip 42. Microphone cable clips, not shown, may also be situated on support member 30 to secure a microphone cable, also not shown. A swiveling boom may also be provided as is known in the prior art. Preferably, the height of support member 30 is telescopingly adjustable, and is comprised of an outer telescoping member or portion 31 which is secured at its lower end in base 20, and an inner telescoping member or portion 32. The relative position of such members can be fixed at a desired height or position by a threaded locking mechanism 34 such as a threaded wing nut fastening of a type known in the prior art located on the upper end of outer member 31, whereby relative movement between the telescoping members during use is prevented and the length of the vertical support member 30 is temporarily fixed or maintained as desired. Alternatively, inner telescoping member 32 can lock in position by rotating inner member 32 in relation to outer telescoping member 31, or various other clamping means known to those skilled in the art can be used.

FIGS. 2–5 illustrate in various views and with various orientations the supporting base 20, while FIG. 6 illustrates the base 20 surrounding a typical foot controller device designated by reference number 90. As will be shown below, the supporting base 20 of the inventor's stand 10 is constructed with a U-shaped frame so that the center portion is relatively open, thereby leaving room for other equipment to also be placed directly in front of the performer. In addition, the legs of supporting base or base central extensions 22 are also horizontally adjustable, so that the base of the stand can be more easily and efficiently arranged around other equipment on a crowded stage. In addition, each of the base support members can be detached from the stand 10 or otherwise adjusted for easier storing or carrying.

Still referring to FIGS. 2–5, base 20 is comprised generally of hub or central portion 22, first and second telescoping or extensible corner members 50*a* and 50*b*, and first and second telescoping or extensible leg members 60*a* and 60*b*. In combination, such parts form a generally U-shaped frame or supporting base having an open center and enable base 20 to be situated in a finite number of different generally horizontal configurations so that the stand 10 does not interfere with the placement of other electronic equipment on a stage or performing area directly in front of the performer. Each of such parts is preferably made from the same material, which can be any suitable material such as anodized aluminum, hard plastic, steel or the like.

Upwardly facing stand socket 24 is situated generally at the midpoint of central portion 22. As is most clearly shown in FIGS. 1 and 4, outer portion 31 of telescoping microphone support 30 is placed in and coupled to socket 24 by threaded securing members 70 and 72. While stand socket 24 is shown in the FIGS. as having a rectangular shape to accommodate the rectangular base of coupling member 36 on the bottom of the outer portion 31 of microphone support rod 30, such socket 24 can be in any shape depending primarily upon the shape of particular coupling member. In addition, coupling member 36 may be either a permanent part of the support rod 30 or may be slip fitted over the bottom of the support rod 30. Socket 24 is preferably coated with a rubber material that acts as a barrier to prevent floor vibrations from passing through the stand and support rod to the microphone, thereby greatly reducing the risk of feedback vibrations interfering with the quality of the sound.

First and second outer sleeves 26 and 28 of central portion 22 extend horizontally from opposite sides of sleeve or stand socket 24, while corner members 50*a* and 50*b* are telescopic coupled in sleeves 26 and 28. As best shown in FIG. 3, corner member 50*a* is comprised of first inner sleeve 54*a*, corner piece 56*a*, and, aligned perpendicular to first inner sleeve 54*a*, outer sleeve 58*a*. Similarly, corner member 50*b* includes second inner sleeve 54*b*, corner piece 56*b*, and, aligned perpendicular to second inner sleeve 54*b*, outer sleeve 58*b*. See FIG. 3, which shows the inner sleeves extended and therefore visible. First and second inner sleeves 54*a* and 54*b* are sized to telescopingly couple with first and second outer sleeves 26 and 28 on central portion 22, respectively. Threaded screw members 74*a* and 74*b* are adjustably secured in threaded apertures generally near the outer ends of sleeves 26 and 28, respectively, for jam holding inner sleeve sections 54*a* and 54*b* in position with respect to outer sleeves 26 and 28. Although parts 54*a*, 56*a* and 58*a*, and 54*b*, 56*b* and 58*b*, respectively, are labeled separately, preferably they are integrally made as a single cast or otherwise fabricated piece. In addition, in each case, the threaded screw members are shown as having a wing nut on the exterior of an underneath threaded fastening to jam against a sliding section below to maintain the sections in position with respect to each other. However, the wing section could also be a hexagonal or other head fastener or bolt adapted to impinge against the adjacent member and jamb fit the two together. Other suitable fasteners could also be used. Hand screw members 76*a* and 76*b* may also be threadably secured in apertures on the top face of corners members 50*a* and 50*b*, respectively, while screw members 78*a* and 78*b* are threadably secured in apertures near the outer ends of sleeves 58*a* and 58*b*, respectively, to maintain the inner sleeves 54*a* and 54*b* in the end pieces 50*a* and 50*b*. Ground engaging or foot members 51*a* and 51*b*, shown in FIG. 4, are located on the bottom side of corner pieces 56*a* and 56*b* to actually support the front of the base 20 on an underlying support surface. Such foot members may be fixed on the bottoms of corner members 50*a* and 50*b* or may preferably be adjustable with respect to the corner members. Suitable adjustment may be obtained by thread attachment into the corner members or alternatively by the use of threaded type jam fittings, not shown, in the end of the corner pieces.

First and second leg members 60*a* and 60*b* are comprised of inner telescoping members 62*a* and 62*b* having connected on their outer ends members 64*a* and 64*b*. Telescoping members 62*a* and 62*b* are sized to extensibly or telescopingly couple with outer sleeves 58*a* and 58*b*, respectively. In addition, as shown in FIG. 6, adjustable screw-type foot members 66*a* and 66*b* are preferably threadably secured to the bottom side of end members 64*a* and 64*b* so that the pitch or angle of the vertical microphone support column can be adjusted. In most cases, support member 30 is preferably angled towards a musician playing an instrument so that the stand does not interfere with the playing of such instrument held in front of the musician. A further angle or pitch to the support column can be provided by increasing the height or depth of corner members 56*a* and 56*b*, as shown in FIG. 4, or by adding as shown an additional piece onto the bottom side of corner members 56*a* and 56*b*, as illustrated in FIG. 8. Such arrangement also provides room for heavier cables to pass underneath the support members of base 20.

In FIG. 6, base 20, see FIGS. 1 and 2, is shown placed on a generally horizontal surface such as a stage or performing area and adjusted so that the telescoping members are surrounding a foot controller 90 of a type typically used in controlling an electric instrument such as an electric guitar. Base 20 is configured so that it surrounds the controller 90 on three sides, with central portion 22, see FIG. 2, extending along the entire front of the controller 90, first corner member 50*a* being situated at the left front corner of the controller, first leg member 60*a* extending along one side of the controller, second corner member 50*b* being positioned at the right front corner of the controller, and second leg member 60*b* extending along the opposite side. After the base 20 is situated as desired, screw members 74*a*–*b*, 76*a*–*b* and 78*a*–*b* are tightened so that the telescoping members are secured in such position. In addition, as indicated above, stand 10 can be easily angled slightly forward or to one side by adjusting the position of foot members 51*a*–*b* and 66*a*–*b*, respectively. The foot members could also be used to compensate for an unevenness or slant in the stage floor or performing area, which might occur particularly in an older performing facility. In addition, as shown in FIGS. 7 and 8, foot members 51*a* and 51*b* and 66*a* and 66*b* raise the base 20 off the stage floor a sufficient distance so that electric wires 92 operating the effects controller 90, music equipment, or other wires can be easily slipped between floor and the adjustable base members. As indicated above, the angle of the support member can also effect the ability of a musician to play his or her instrument, and can be adjusted accordingly using the foot members.

By using the telescoping base 20 of the present invention, vertical member 30, partially shown in FIG. 6, can be situated so that it is in close proximity to the foot controller and both are in close proximity to the musician while performing with the foot controller 90 centrally located. The musician therefore no longer has to strain or lean to one side, or otherwise compensate for the disparate positions of the microphone and foot controller. In addition, such arrangement more efficiently allocates or utilizes the available space, which is important particularly in a small or cramped performing area. Such an arrangement would not be possible using prior art base systems, which typically comprise a generally circular weighted base member, because it would be impossible to centrally position such base member so that it does not interfere with the placement of the controller.

FIG. 7 is an isometric view of the stand 10 of the invention in use on a stage by a performer 100 playing an electric guitar. Vertical member 30, see FIG. 1, holds or supports a microphone 40, while base 20 surrounds a controller 90, which the performer is using to modulate or otherwise control the details of his performance. It is evident how the stand enables the performer to have both the microphone and the control stand conveniently before him. In addition, the stand is tilted forward so that there is room for the performer to play the guitar while also having the microphone close to his mouth.

FIG. 8 is an isometric view of the stand 10 of the invention used as the base of a music stand 110, rather than a microphone, of a musician playing an electric guitar. It is evident how the stand of the invention facilitates positioning of the music directly in front of the musician with the controls for the instrument also readily available to the musician's feet.

Figure 9:
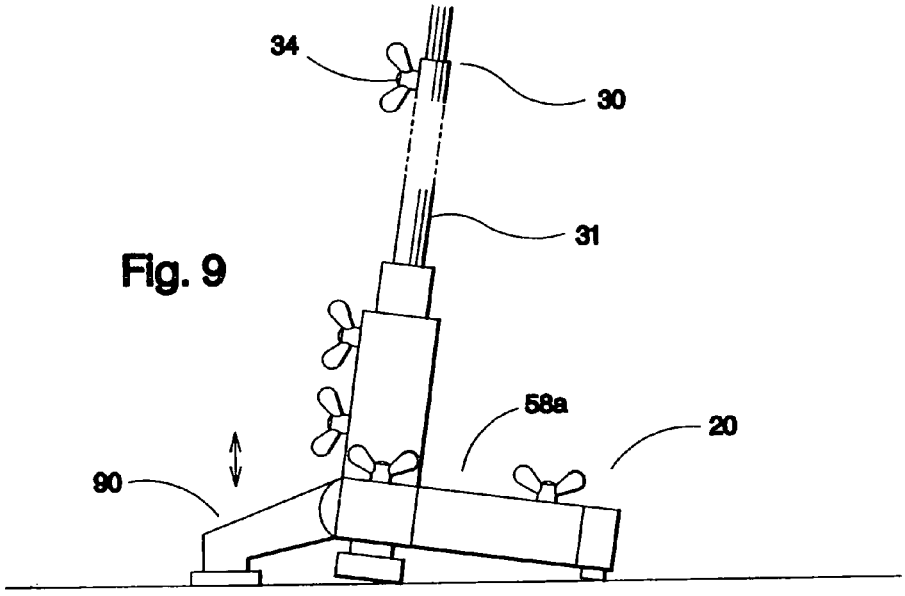
FIG. 9 is a side elevation of another slightly alternative embodiment of the invention.

Other variations to the base 20 may also be provided. For example, it is envisioned that a rubber or other vibration damping layer on base 20 may be provided in addition to rubber coated stand socket 24 to reduce any vibrations from the equipment from interfering with the microphone. FIG. 9 is a side elevation view of another possible alternative embodiment of the invention wherein an extra stabilizing member 98 is provided extending generally opposite the direction of members 58*a* and 58*b* from the front side of stand socket 24. Stabilizing member 90 is provided to eliminate the possibility that the base 20 might tip in such direction, although by angling the base generally forward using the foot members, such possibility has already been substantially lessened. There is always a possibility of the stand being accidentally impacted by movements of the performer or by other accidental forward impact, however, and the stabilizer member 90 guards against such possibility. Member 90 is preferably vertically pivotable so that after stand 20 has been situated as desired, member 90 is pivoted downwardly until it contacts the stage surface, similar to a pivoting door stop. Suitable pivoting may be attained in several different manners, including an adjustable hinge arrangement or the like, not shown. Stand socket 24 has been slightly modified to accommodate placement of member 90. Alternatively, rather than having a single centrally located support member 90, a pair of such support members could be located on sleeves 26 and 28 or first and second corner members 50*a* and 50*b*.

FIGS. 10–15 illustrate another alternative embodiment of the stand 110 having a slightly different base arrangement but wherein the base is also telescopingly adjustable so that it can be accommodated to or placed or situated around other equipment in a crowded stage area. In general, in such alternative embodiment of the base, instead of the base being formed from heavy tubular or cast sections of whatever composition, such base is formed from lighter plastic or aluminum sections, which sections may be square or rectangular or tubular in cross section. The heavy tubular or cast construction tends to be fairly steady upon a performing stage or platform because of its substantialness, but heavier and more difficult to transport. The alternative base is formed from lighter, thinner tubular sections that can be easily folded together and transported, but may be less steady and more easily toppled by accidental impact without being unduly unstable. The same principle of having the supporting arm extending upwardly at an angle from the base and having legs or base sections extended to the side and then rearwardly at the ends in the same direction as the inclination of the microphone or other support and having a space in the center into which foot control equipment may be centered is adhered to and the base sections are adjustable in two directions, i.e. forward and back and to the side by preferably a telescoping construction. Since the tubular sections are fairly light gauge, the device, while still fairly steady, is lighter and easy to transport. The central section may also be easily disassembled, if desired, for transportation.

Figure 12:
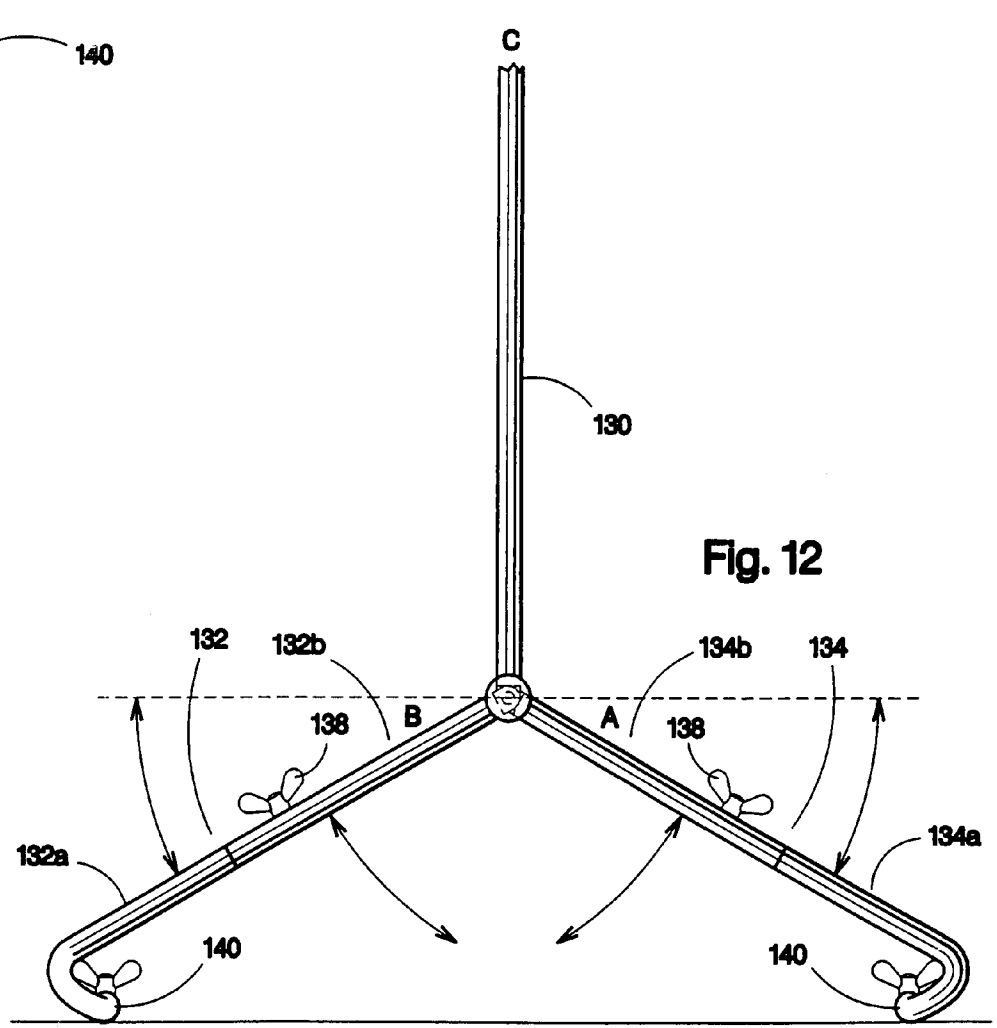
FIG. 12 is a front view of the stand shown in FIGS. 10 and 11 with the leg members slightly pivoted away from a support surface.
Figure 10:
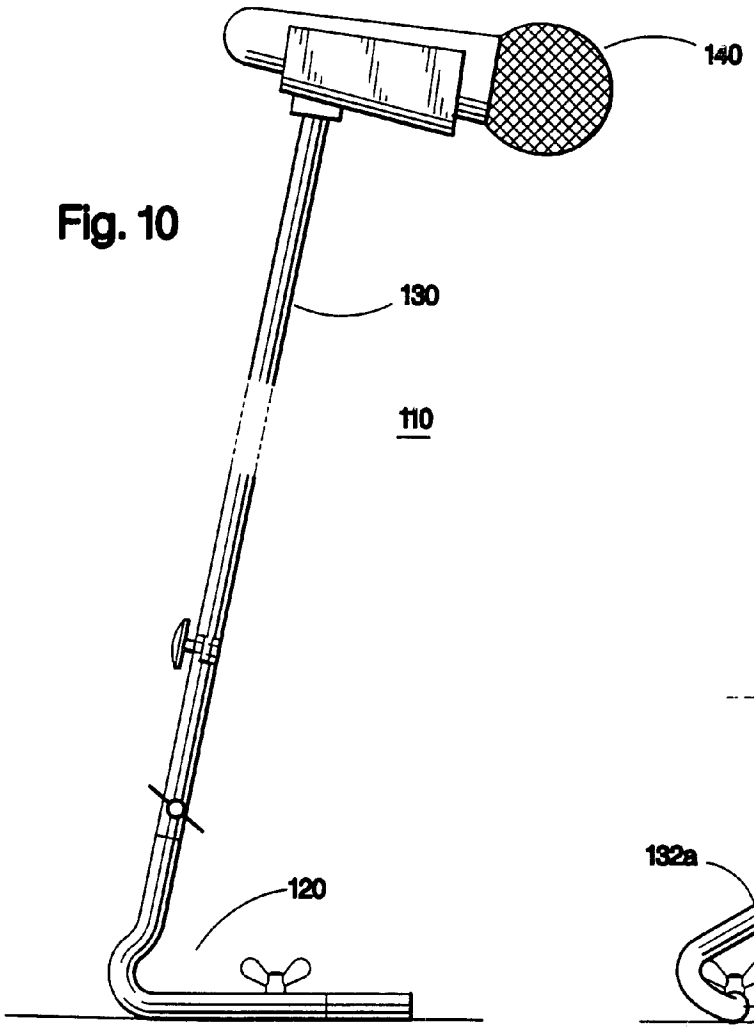
FIG. 10 is a side elevation view of another alternative embodiment of the invention.
Figure 13:
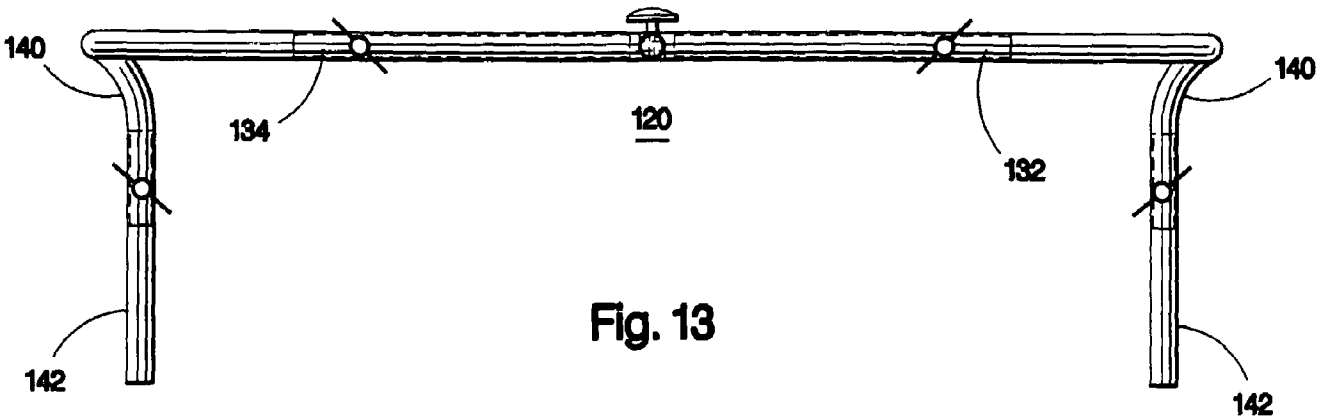
FIG. 13 is a top view of the base of the stand shown in FIG. 10.
Figure 11:
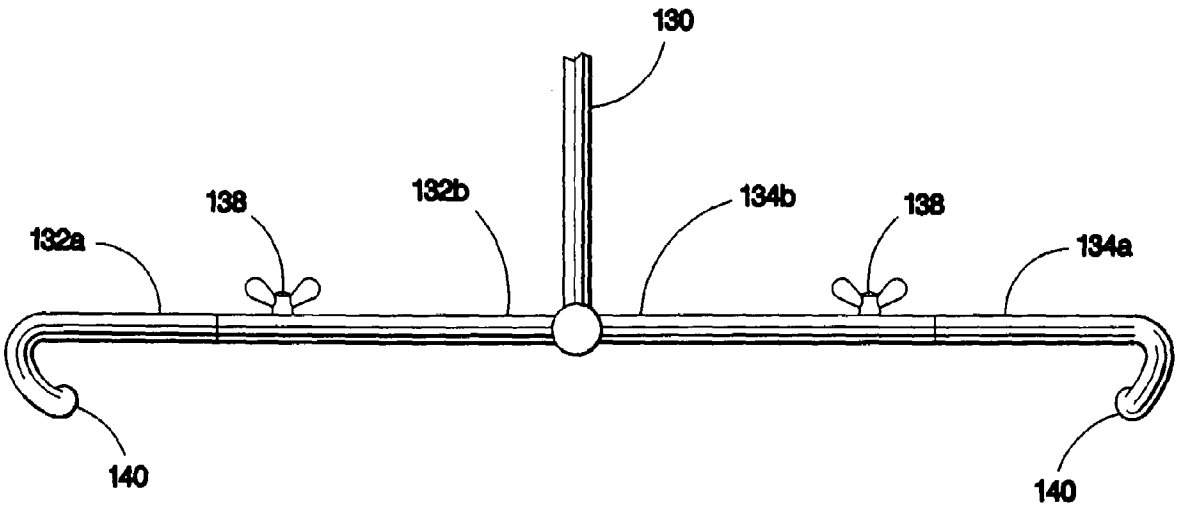
FIG. 11 is a rear view of the stand shown in FIG. 10, as it would normally be viewed from the audience side.

FIG. 10 is a side view of stand 110 which is comprised of base 120, adjustable support member 130, and any suitable clip or holder for microphone 140. As shown in FIGS. 11 and 12, base 120 is comprised of two outwardly extending leg members 132 and 134. Preferably, each leg member 132 and 134 is comprised of inner and outer telescoping sections 132*a*–*b* and 134*a*–*b*, which are secured or held together by threaded jam members 138. In addition, the leg members preferably have downwardly curved outer ends which form feet 140. Leg members 132 and 134 are generally pivotable from a position shown in FIG. 11, where the legs are situated so that they are generally horizontal to the floor or stage surface while support member 130 is perpendicular to such leg members, to a position such as shown in FIG. 12, where the legs have been pivoted so that they are angled in relation to the floor, as indicated by the arrows. As is visible in FIG. 13, which is a top view of the base 120, feet 140 are generally angled downwardly and then extend at right angles from leg members 132 and 134 so that a U-shaped arrangement is formed. Extending outwardly from the ends of feet 140 are telescoping side or foot members 142, which are adjustable in the same manner as in the previously described embodiments.

Figure 14:
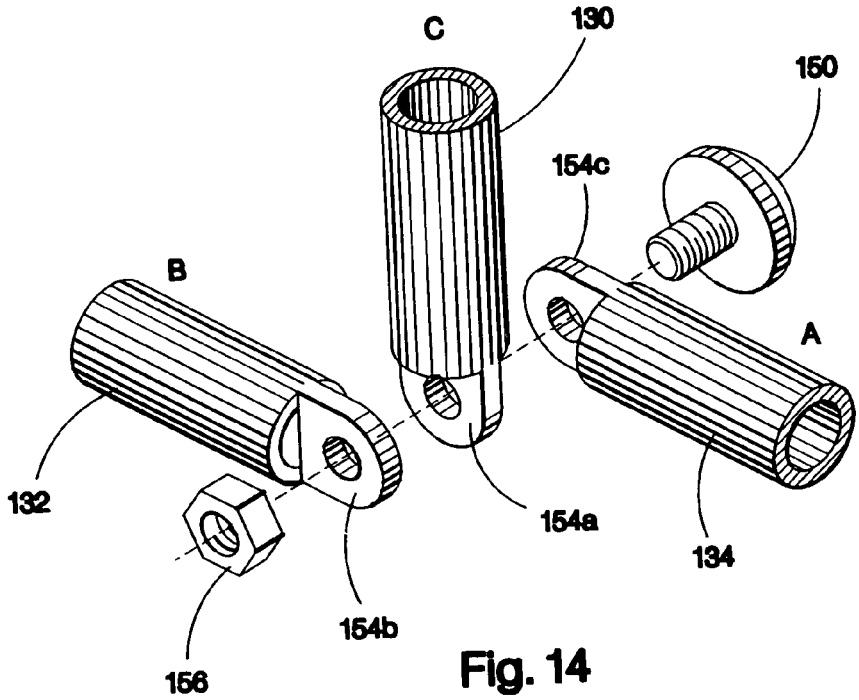
FIG. 14 is a close-up isometric view of the arrangement for attachment of the leg members to the support member in FIG. 10 shown disconnected or disassembled for clarity.
Figure 15:
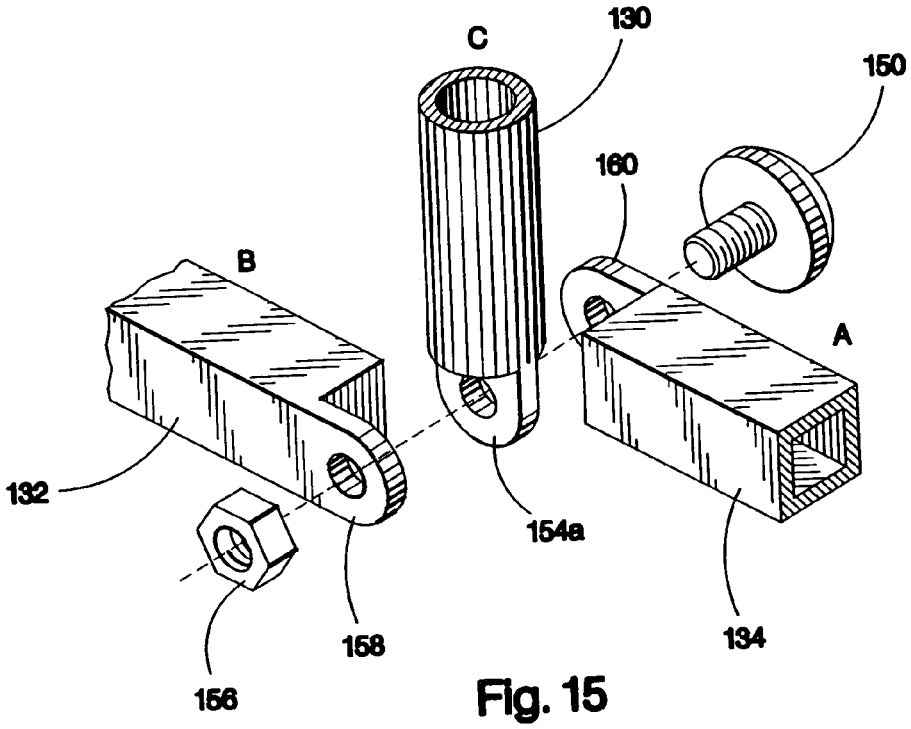
FIG. 15 illustrates a slightly alternative arrangement for attachment of the leg members to the microphone support member also shown disconnected or disassembled for clarity.

FIGS. 14 and 15 show two slightly different arrangements for securing leg members 132 and 134 to microphone support member 130. In FIG. 14, apertures 154*a*, 154*b*, and 154*c* are positioned on or near the ends of support member 130 and leg members 132 and 134, respectively. Bolt 150 may be passed through each of such apertures and secured by nut 156 so that leg members are pivotable about the same point. In FIG. 15, leg members 132 and 134 have upper and lower generally horizontal offset portions 158 and 160 to which apertured end 154*a* of support member 130 is pivotably secured. Either arrangement is an acceptable means for enabling the angle of leg members 132 and 134 to be easily adjusted. It will be understood that the intersecting sections containing fastening orifices will be oriented so that when connected together by suitable fastenings the base sections will extend to the side while the microphone or apparatus support section will extend upwardly with a slant in the same direction as the end of the legs of the base. As shown in FIG. 10, for example, support member 130 is preferably angled slightly forwardly as in the previous embodiments. In addition, FIG. 11 shows that sufficient room is provided between the floor or stage area and leg members 132 and 134 for wiring or cables to be strung, making setup of electronic equipment even easier. Each of the embodiments shown accomplishes the same purpose of providing sufficient space directly in front of a performer for placement of equipment in addition to a microphone stand, thereby improving the ability of a musician to give an effective and enjoyable performance.

The inventor has now as the result of further development work realized that the invention has applicability to other uses by a musical artist than use merely as a microphone or music stand the base of which, by surrounding a foot control apparatus can provide better use of stage space. Stage space is of tremendous importance where such space is not particularly great. It has now become evident that the same principle according to which the microphone stand base has been constructed can be applied as well to effective use of the stand of the invention as a stand for holding instruments such as spare, or alternative, guitars or other stringed instruments, or, indeed, any instrument at all, plus, where desired smaller electronic control apparatus or other elements are used support of such equipment and further that the U-shaped base will fit very neatly about relatively large heavy equipment such as, for example, amplifier equipment which can fit nicely into the broadly U-shaped space within the open side of the adjustable and foldable base. For example, a musical artist may wish to use the stand as a microphone stand with the base compactly surrounding a foot control of various types, plus use another more or less identical stand having its base surrounding a loudspeaker plus use various trays or holders attached to a sturdy upstanding rod or a post extending upwardly from the base, whereby electronic control elements of the foot controller may be supported upon a rack clamped to the supporting rod or post. A loudspeaker may be placed in the space defined by the legs of the base, with the further support at a quick accessibility level upon the post of a spare instrument such as a guitar resting upon brackets clamped at a convenient height upon the support rod. The inventor has also designed special strengthened brackets for use on his support rods or posts connected to his base plus a smaller folded base attained by use of folding telescoping end pieces rather than fixed telescoping end pieces of earlier embodiments thereby adding increased convenience for transportation and/or storage. The inventor has also created a combined microphone stand and front balance leg for his adjustable musician's stand. Such further improvements and adaptations are shown in the following described drawing figures.

Figure 16:
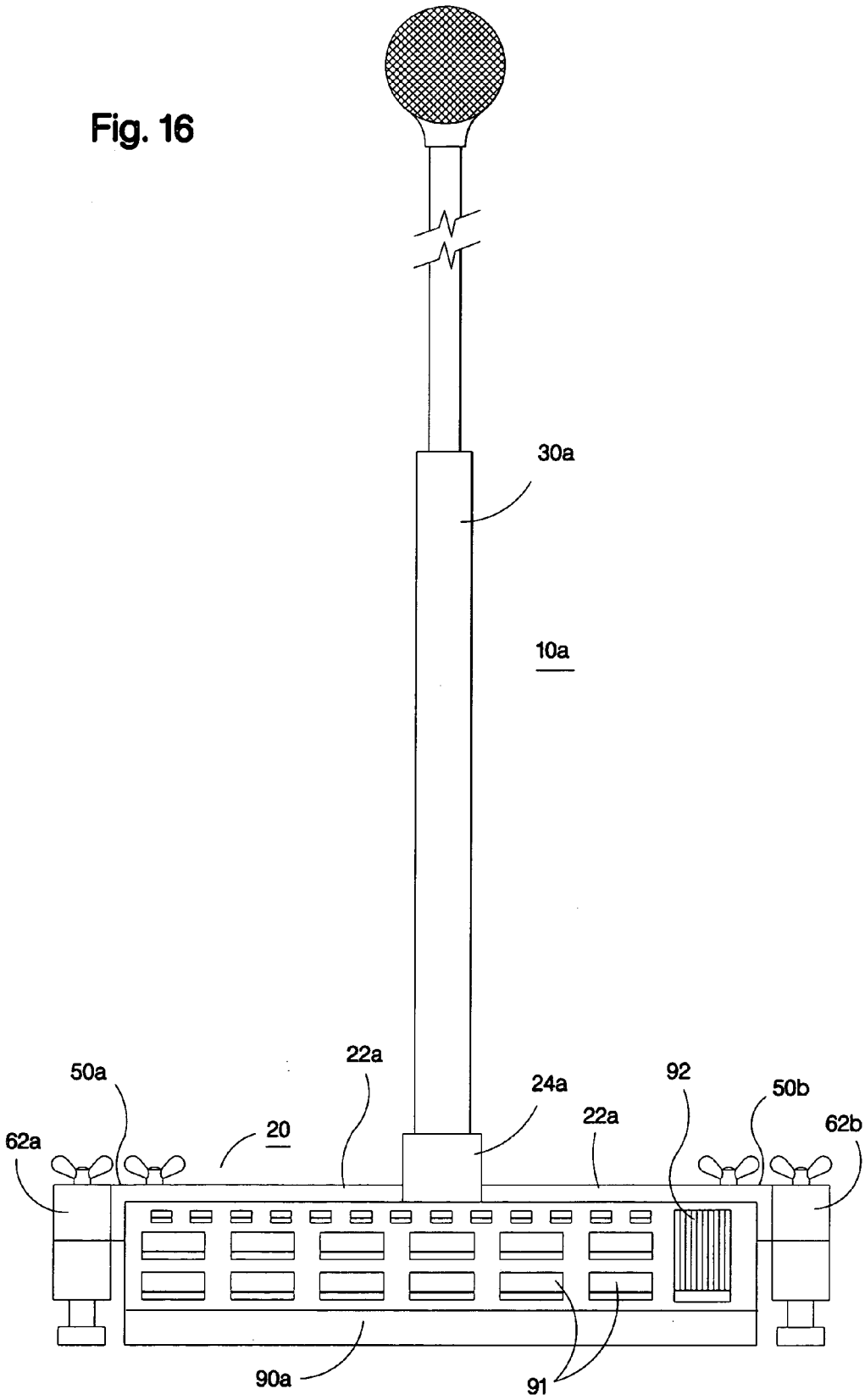
FIG. 16 illustrates a further embodiment of the invention incorporating a wider U-shaped stand in which a wider and more sophisticated foot controller may be accommodated directly in front of a musician on a stage or the like and accommodating a square microphone support post.

FIG. 16 is an isometric view of an expanded foot pedal type control for controlling the sound and sound effects of a loudspeaker and sound effects system surrounded by a longitudinally and laterally expandable base in accordance with the inventors principal embodiment shown in FIGS. 1 through 9 the embodiment of the microphone stand 10*a* shown in FIG. 16, however, being significantly wider appropriate to the wider foot control. The foot control 90*a* has a series of foot pedals or buttons 91 which can be pressed to implement various electronic and sound modulation effects as known in the art, plus a longer rocking pedal 92 which will usually control the loudness of the system dependent upon how far the pedal is depressed as well known in the art. The pedal 92 is designed to have a fair range of movement so that precise control of volume can be effected. The base 20 has fairly long tubular sections 22*a* extending from the central holder or socket 24*a* or across the central portion of the base 20 under the microphone socket 24*a*. A pair of two legged L-shaped end pieces 50*a* and 50*b* as in FIG. 2 complete the end of the base 20 and telescoping legs 62*a* and 62*b* extend from these. A microphone stand or post 30*a* extends upwardly from the socket 24*a*. FIG. 16, therefore, illustrates a stand basically similar to the stand shown in FIGS. 1 through 9 extended about a wider foot control than shown in FIGS. 6 to 8. Such foot control may have its state of the art electronics either in the foot control itself or housed in a second controller which can be supported away from the floor upon a stand or table or the like where it is better separated from shocks and damage due to rough treatment of the foot controller by the instrumentalist or performer.

Figure 17:
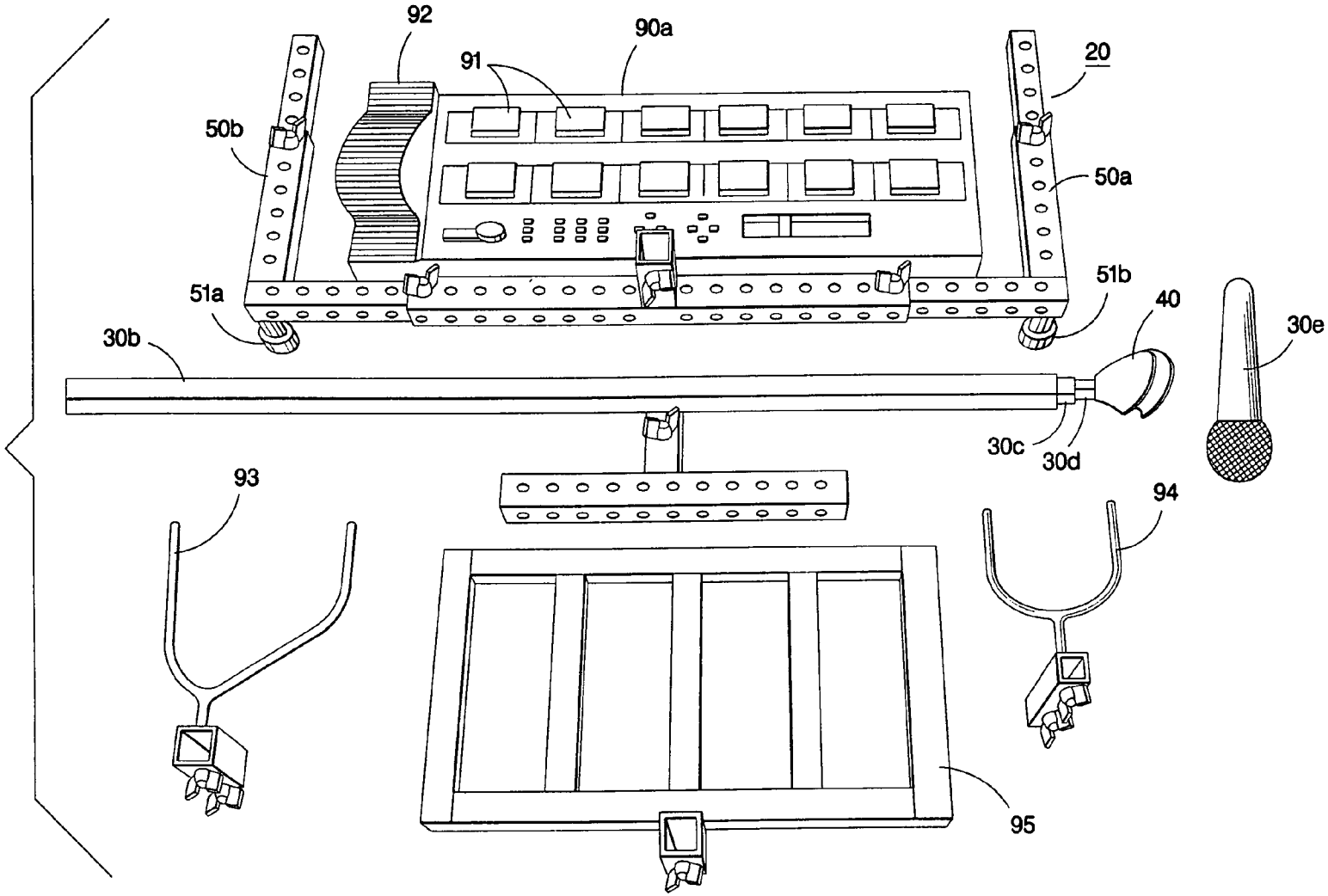
FIG. 17 shows the microphone stand shown in FIG. 16 disassembled and laid out on a surface ready to be assembled for use either in the configuration shown in FIG. 16 or with an alternative arrangement or configuration as a backup stand as shown in FIG. 18 in which a loudspeaker may be accommodated in the central section and several forms of racks may be mounted on the support post.

FIG. 17 shows in isometric projection from the front above the parts of the stand 10*a* laid out upon a surface after disassembly with the base 20 still extended, for illustration, about the foot control 90*a*. In addition, several innovations are shown which are not shown in FIG. 16 including a sturdy square tubular microphone stand 30*b* which accommodates a telescoping central square tubular member 30*c* for expansibility with a cylindrical microphone support fitting 30*d* attached to the top with a microphone 40 at the end. Such square tubular support 30*b*, as will be explained, may do double duty as part of a support stand when used alternatively to support other elements of a musician's equipment including electronic control means plus extra instruments and the like. Also shown in FIG. 17 are two instrument brackets 93 and 94 which can be fitted over the square tubular member 30*b* and clamped with screw clamps plus a tray support 95 also provided with a square tubular clamp which fits over the support rod and can be clamped by wing type threaded 30*b* and can be clamped by wing type threaded clamping means at any desired level. The small adjustable screw-type feet 51*a* and 51*b* can be seen in FIG. 17 on the front of base 20 (as used for support of a microphone) at the bottoms of the two end pieces 50*a* and 50*b*. The further brackets 93 and 94 plus the tray support 95 may be used attached or clamped to the support rod 30*b* when used as a utility or spare instrument support. See FIGS. 18 and 19.

Figure 18:
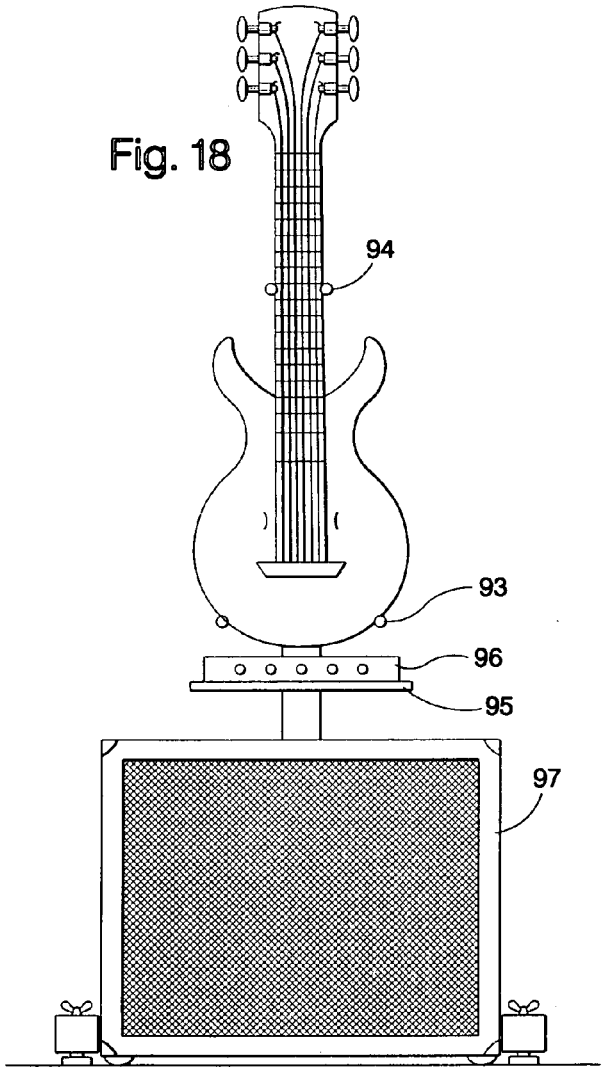
FIG. 18 shows the alternative configuration into which the equipment of FIG. 17 may be formed together with a loudspeaker that fits between the telescoping leg portions and a guitar supported on the rack.
Figure 19:
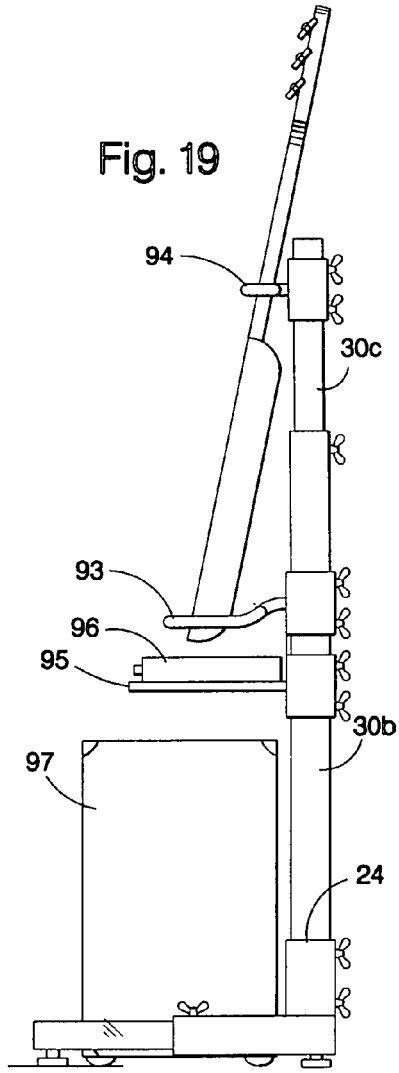
FIG. 19 is a side view of the stand configuration shown in FIG. 18.

FIG. 18 is a front elevation and FIG. 19 is a side elevation of the base and support of the invention when used in an alternative fashion, for example, in FIGS. 18 and 19, as a support for a spare instrument readily and almost instantaneously available to an instrumentalist from a rack in back of such instrumentalist. Racks or brackets 93 and 94 clamped onto the support rod 30*b* are shown as well as tray-type support 95 also clamped on the support rod 30*b*. The tray-type support 95 is shown with the electronic control case 96 for the foot control unit 90*a* supported upon it. It will be understood, however, that the tray 95 could be used to support anything else desired including even the lower end of one of the instruments. Ordinarily, however, the bracket 93 will be used to support the lower end of an instrument and the bracket 94 will be used to hold the upper end of the instrument. It may be readily noted in FIG. 19 that each of the brackets 93, 94 and tray 95 are provided with two threaded interlocks on their slide bases encompassing the support rod 30*b*. Also the socket 24, as in FIGS. 4 and 5, is provided with dual screw clamping means. Under the tray bracket 95 supporting the electronic control 96 and between the legs 58*a* and 58*b* is a large amplifier 97 through which the musician's program and musical accompaniment may be broadcast. The slide portion of the brackets 93 and 94 and tray 95 may have larger or smaller open slide portions depending on which portion of the support post is to be clamped upon.

Figure 20:
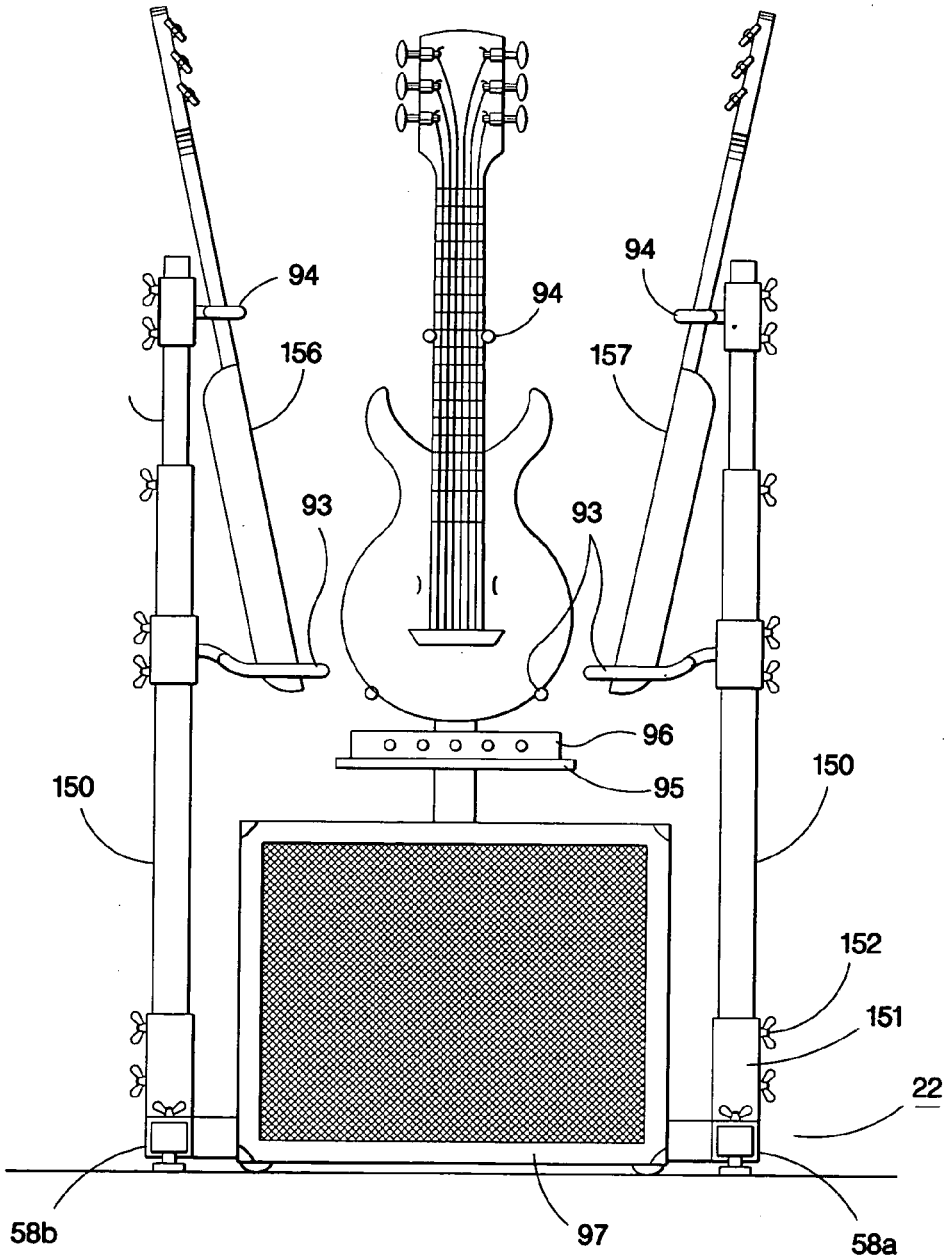
FIG. 20 is an elevation of a modification of the arrangement shown in FIG. 19 with the addition of two additional side posts for the support within easy grasp of additional items such as two additional guitars as shown.

FIG. 20 is an elevation of a further elaboration of the stand apparatus shown in FIG. 18 in which not only is there a broad U-shaped base 22 surrounding an amplifier 97 with an electronic controller 96 accommodated on a tray 95 above it clamped to a square or rectangular post to which brackets 93 and 94 are attached or adjustably clamped, but there are in addition two further support posts 150 secured to the outer legs 58*a* and 58*b* preferably in a manner to be described. These two posts 150 are mounted in sockets 151 extending upwardly from the legs 58*a* and 58*b* and as shown have double threaded clamp means 152 to clamp the posts 150 securely in them in a manner similar to that shown in FIGS. 1, 4, 5 and 19. These sockets 151 may be attached to the legs 58*a* and 58*b* in several manners the easiest way being shown in FIG. 21 described below.

Figure 21:
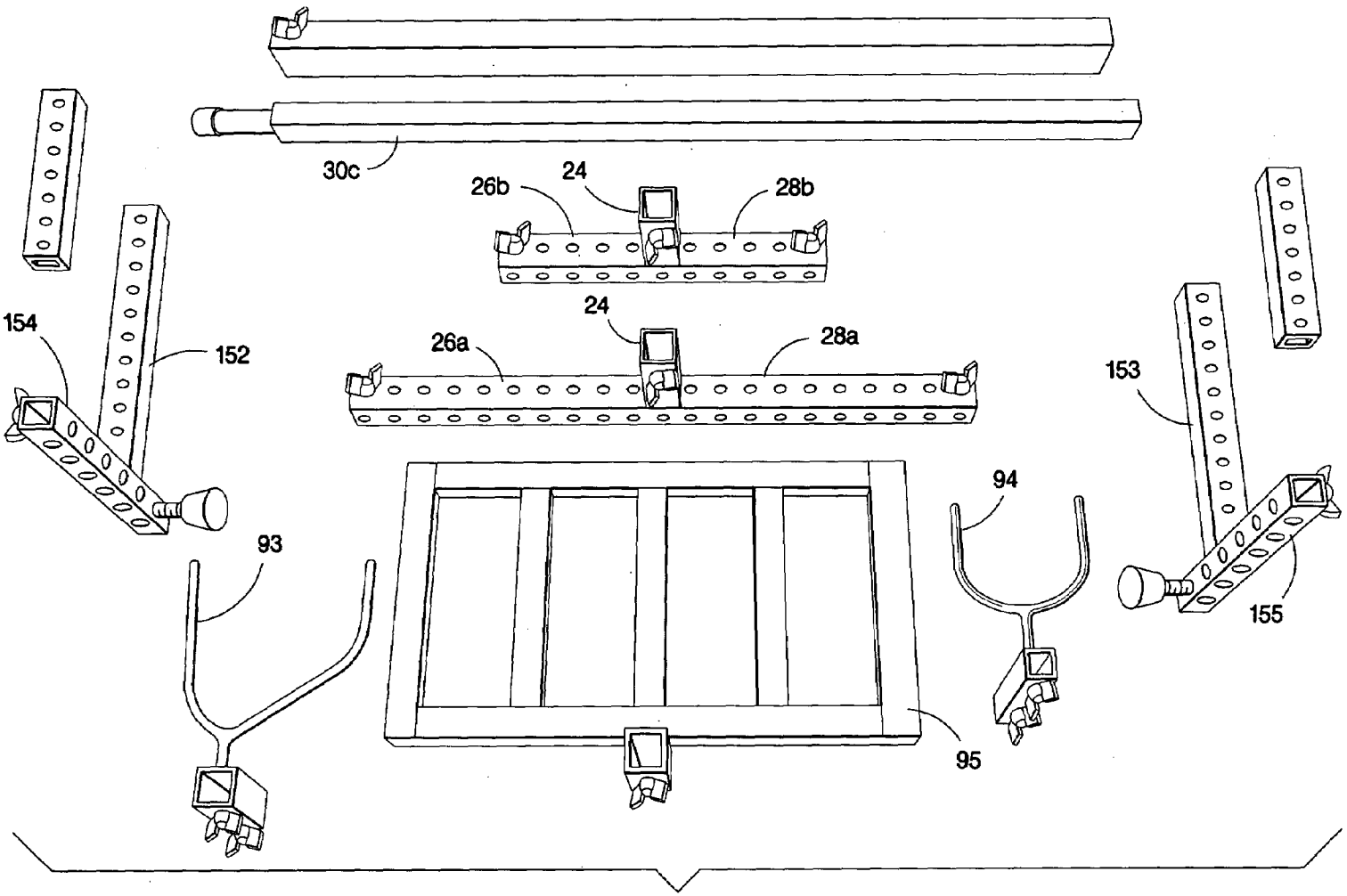
FIG. 21 is a view of the parts of the apparatus shown in FIG. 20 laid out ready to be assembled including side brackets to support the telescoping side posts.
Figure 29:
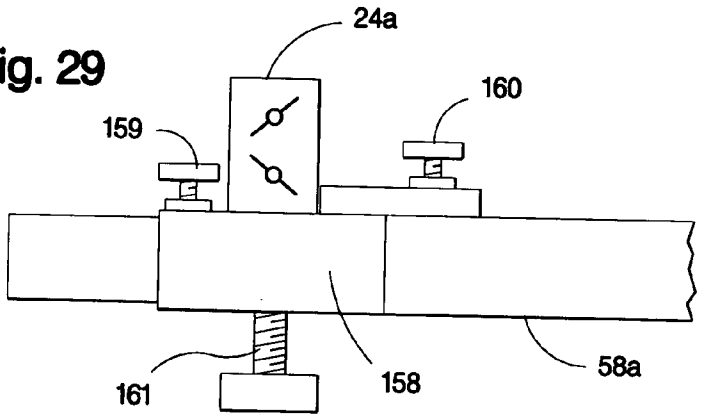
FIG. 29 is a side view of the bracket of FIG. 28 installed on an end leg of the stand base.

FIG. 21 shows the various pieces of the stand shown in FIG. 20 laid out after or before assembly except for the end pieces or corner pieces 50*a* and 50*b*. There are shown two alternative central pieces or front legs 26*a* and 28*a* and 26*b* and 28*b* each with a central socket 24 for receipt of the central post 30*b* or 30*c*. To these would be added a corner piece 50*a* and 50*b*, not shown, arranged with square tubing to receive the ends of the base legs 26 and 28 plus the end sections or legs 62*a* and 62*b*. The sections 152 and 153 may be substituted for these end legs. Sections 152 and 153 both have an upstanding socket 154 and 155 which may accommodate posts 150 together with their brackets 93 and 94 for support of musical instruments such as guitars and the like, 156 and 157. (See FIG. 20). A further arrangement for attaching the posts 150 is shown in FIGS. 29 and 30.

Figure 22:
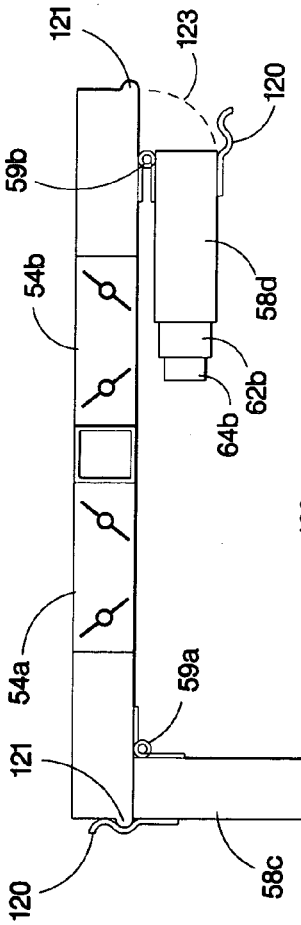
FIG. 22 is a plain view of an improved end construction for the base of the stand in which the extensible sides of the U-section may fold parallel to the main or front piece.
Figure 22A:
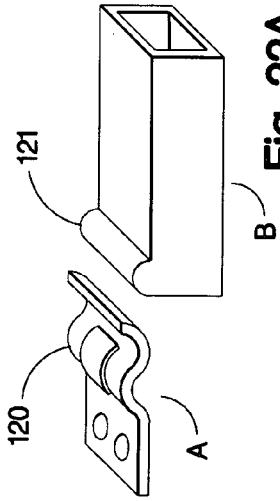
FIG. 22A is an enlarged view of the locking action of the catch which holds the pivoting end pieces in the folded position.

FIG. 22 discloses a further improvement of the end legs 58*a* and 58*b* shown in previous figures. In this improved arrangement the end section instead of being a rigid fitting 50*a* and 50*b* shown in previous figures with sleeves for telescopic connection to other sleeve or leg sections such end piece or leg sections is instead formed from a section of square tubing 58*c* and 58*d* hinged to the sliding tubing of the sections 54*a* and 54*b* at hinges 59*a* and 59*b*. The telescoping ends 62*a* and 62*b* shown in previous figures continue to extend from the sections 58*c* and 58*d*. A spring catch or lock 120 engages with a detent 121 when the sections 58*c* and 58*d* are swung out perpendicular to the sections 54*a* and 54*b* when in use. The hinged sections may be swung back, however, into storage position as indicated by dashed line 123 at which time they lie compactly parallel to the sections 54*a* and 54*b* as shown in FIG. 22 on the right of the drawing creating a more compact package for storage. FIG. 22A is an enlarged view of the spring catch 120 and the detent on the end of telescoping sections 54*a* and 54*b*.

Figure 24:
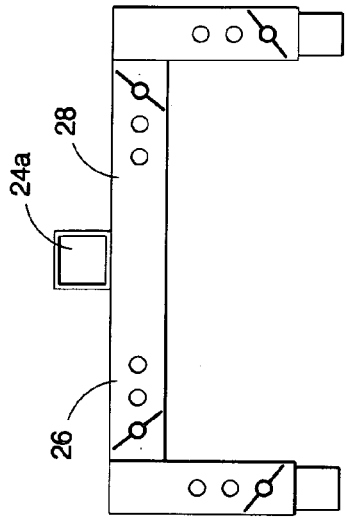
FIG. 24 is a plain view of the base of the invention shown in FIG. 23 without the center post or microphone post.
Figure 23:
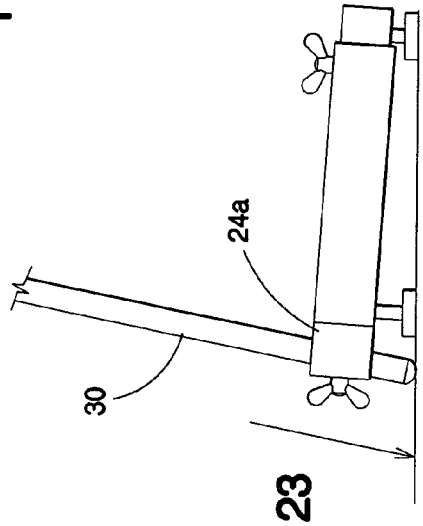
FIG. 23 is a side elevation of a portion of the base of the invention showing an alternative arrangement in which a microphone stand may be attached to the side of the base and extended to the underlying surface to serve as an additional brace to prevent forward instability of the stand.

The present inventor has also realized that the lower portion of center or support post 30 of the stand of the invention may be substituted for the forward leg 90 shown in FIG. 9 for balance. This is accomplished as shown in FIGS. 23 and 24 where it is shown that the socket 24*a* can be attached to the base on the side of the front cross members 26 and 28 and be provided with an open bottom so that the post 30 itself can be extended downwardly to contact the stage as a further balancing leg as well as a support post. In this arrangement the socket 24*a* can be provided with a single or double screw clamping arrangement, particularly, since considerable of its weight will be supported by the performing stage surface itself.

Figure 25:
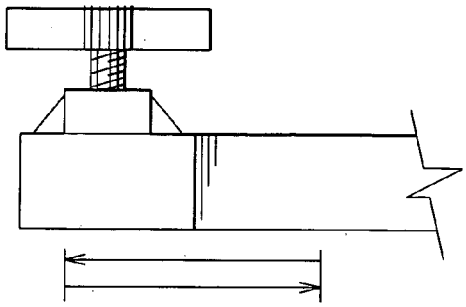
FIG. 25 is a side view of a typical screw threaded interconnection on adjustable length sections.
Figure 26:
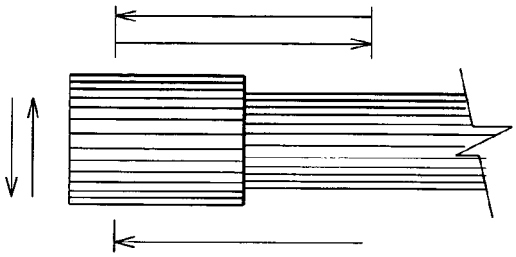
FIG. 26 is a side view of a typical twist type friction lock between sliding post parts which is used on most telescoping microphone stands and can be adopted for use in the present invention when the interconnecting slide members are cylindrical in shape.

The telescoping members of the stand of the invention can in each case be interlocked in operating position either by a screw-threaded clamping arrangement particularly as shown as a generality in FIG. 25 for either rectangular or cylindrical members or by a common twist friction lock when used on cylindrical members. Such twist friction locks are very common, for example, on microphone stands. See FIGS. 25 and 26 where FIG. 25 indicates diagrammatically the use of a screw-type interlock to lock two sliding or telescoping members together and FIG. 26 illustrates diagrammatically an equivalent twist friction lock for the same purpose, but usually confined to use on a cylindrical member. The arrows indicate the sliding relationship between the members when unlocked as well as the twisting movement of the lock section.

Figure 27:
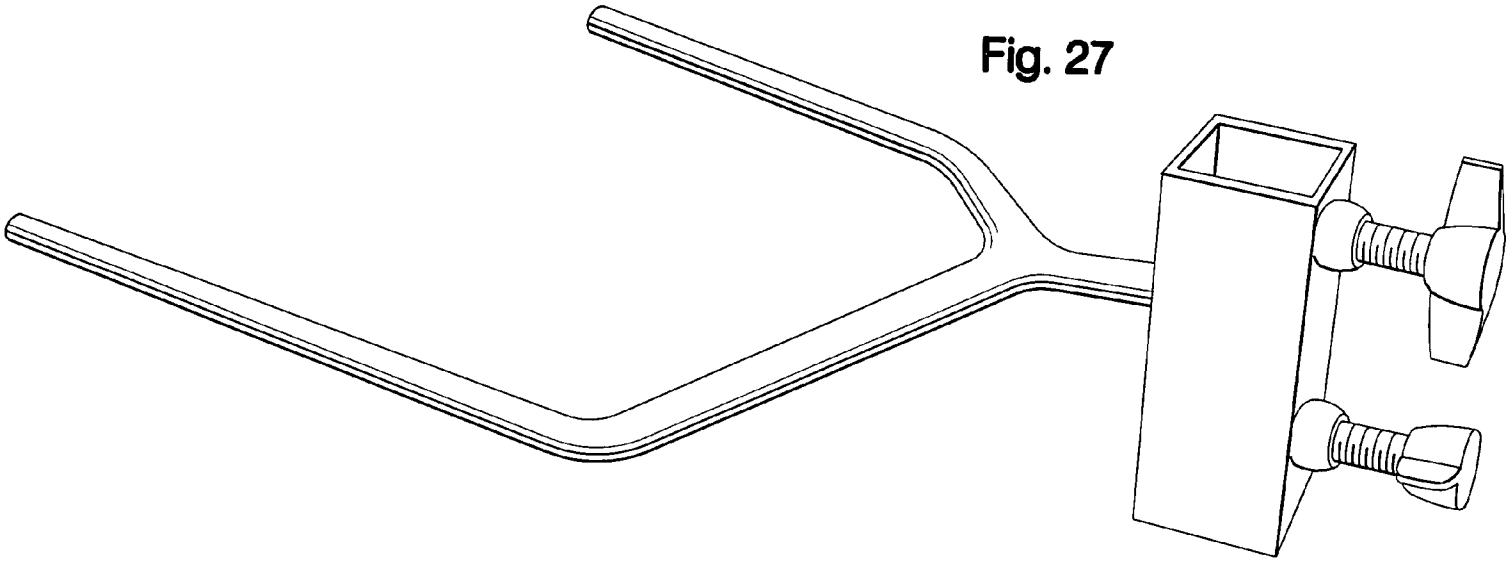
FIG. 27 is an isometric view of a double screw threaded interlock sliding holder for use on the vertical supports or posts of the invention where additional security in the interlock with the vertical support is desirable or required.

FIG. 27 is an isometric view of one of the applicant's sliding brackets with double screw interlock means. If the post upon which it was to be mounted was cylindrical the collar or sleeve would be preferably cylindrical as well, but the double screw threaded interlock would remain basically the same.

Figure 28:
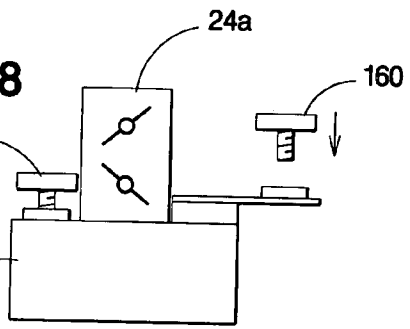
FIG. 28 is a side view of an alternative bracket for support of the side posts shown in FIG. 20.

FIG. 28 shows a connector 158 having a lower tubular section which may slide over one of the end legs 58*a* or 58*b* and interlock therewith by means of threaded members 159 and 160. The end post 150 may then be inserted into the socket 24*a*. A screw-threaded foot 161 may be screwed into the bottom of the fitting or connector 158. FIG. 29 shows the fitting 158 connected to or between the legs 50*a* and 60*a* and/or 50*b* and 60*b*.

The inventors modification of the basic stand of the invention so it can by the use of various additional accessories plus the use of improved refinements such as folding end legs on the base, arrangement of the upper socket on the front side of the base so it can serve double duty as a balancing leg and use of double screw locked brackets to hold accessory trays and brackets to the supporting brackets has substantially increased the utility of the invention.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A musical performer's stand base for supporting at least one accessory to musical performance comprising:

(a) a U-shaped base having a central base portion for supporting a vertically extending support member, (b) a first pair of telescoping legs extending from opposite sides of said central base portion, and a second pair of telescoping legs extending perpendicularly from said first pair of telescoping legs in operating positions, (c) said central base portion and pairs of telescoping legs defining an adjustably dimensioned open area within the U-shaped base whereby the configuration and dimensions of said open area adapted to encompass a directly floor supported apparatus used as an aid in musical performance can be adjusted depending upon the size of said apparatus by individually adjusting the telescopic positions of said first and second pairs of telescoping legs at various multiple positions to encompass said apparatus.

2. The musical performer's stand base in accordance with claim 1 additionally comprising:

(d) a vertically extending support member connected to said central base portion, and (e) at least one means for supporting an accessory to musical performance connected to said vertically extending support member.

3. The musical performer's stand base in accordance with claim 2 additionally comprising:

(f) at least one bracket means for movably securing said musical accessory support means to said vertical support member so that said musical accessory is secured at a position substantially in the central portion of the U, and (g) means for preventing relative movement of the first and second pairs of telescoping legs.

4. The musical performer's stand base in accordance with claim 3 additionally comprising:

(h) hinge means for securing the second pair of telescoping legs to the outer ends of the first pair of telescoping legs, and (i) an interlock means as provided to hold the second pair of telescoping legs perpendicular to the first pair of telescoping legs.

5. The musical performer's stand base in accordance with claim 2 wherein the vertically extending support member is comprised of an outer telescoping member secured on one end to the support base and an inner telescoping member having a means for attaching a microphone on its upper end.

6. The musical performer's stand base in accordance with claim 2 wherein the means for supporting least one accessory to musical performance comprises one or more supports for musical equipment.

7. The musical performer's stand base in accordance with claim 1 additionally comprising:

(d) at least one vertically extending support member connected to either said central base portion or to one of said telescoping legs, and (e) at least one means for supporting an accessory to musical performance connected to each vertically extending support members.

8. The musical performer's stand base in accordance with claim 7 wherein a vertically extending support means is connected to said central base portion and at least one vertically extending support means is connected to one of said second pair of telescoping legs.

9. A base for a substantially vertically extended support member comprising:

(a) a principal base member with a coupling for attachment of a vertical support adapted to support an aid to a musical artist at a convenient level to access by the musical artist, (b) at least two first extensions opposite to each other from the principle base member adapted along with the principal base member to be supported upon a stage surface, (c) the first extensions from the base member being outwardly adjustable from the vertical support coupling, (d) at least two second extensions positioned outwardly from the principal base member and extensible at a substantial angle from the first extensions near the outer ends of said first extensions, and (e) the positioning of the extensions being such as to form an open area in front of a musician using the support member, and (f) each of the first and second extensions being itself expansible longitudinally so that the dimensions of the open area in front of a musician can be expanded or adjusted at various multiple positions as needed to allow the musical artist to utilize said open area for placement of one or more additional pieces of equipment and the like in close proximity to the artist with the base substantially surrounding said equipment.

10. A base in accordance with claim 9 wherein the extensions are expansible by a telescoping action.

11. A base in accordance with claim 10 additionally including (h) jam screw members for temporary fixing the extensions in any given extended position.

12. A base in accordance with claim 10 wherein the at least two second extensions positioned outwardly from the principal base member are pivoted to the first two extensions in a manner such that they can be folded substantially parallel to such first extensions when in storage, but held substantially perpendicular to such first two extensions when in use as a base for a support member.

13. A base in accordance with claim 10 wherein the attachment for a vertical support allows the vertical support to pass through the attachment and contact the supporting surface adjacent to the outside of the support in clamped position to provide a balancing support.

14. A base in accordance with claim 9 additionally including (g) surface contacting feet at the ends of at least some of the extensions.

15. A musical accessory support stand having an expansible U-shaped base with an adjustable opening in the form of a broad letter-U for extending around floor equipment during use, the base being comprised of:

(a) first longitudinally telescoping expansible members extending on each side of a bracket for holding a substantially vertical telescopable support member, (b) second longitudinally telescoping expansible members positioned during use at the ends of the first telescoping members, (c) a first telescopable expansible support member for supporting a musical accessory arranged to extend generally upwardly away from said bracket at approximately the center of the base, (d) wherein said expansible support member is secured to the base along the side of the base such that with its base supported upon the supporting surface which supports the base and is clamped to the base securely so that the lower end of the expansible support member aids in stabilizing the base against overturning.

16. The musical accessory support of claim 15 additionally comprising at least one auxiliary expansible support member secured to the base spaced from the first support member.

17. The musical accessory support of claim 16 wherein there are two auxiliary expansible support members on opposite legs of the base space from the first support member.

* * * * *